US005872579A

United States Patent [19]

Handa et al.

[11] Patent Number: 5,872,579

[45] **Date of Patent: *Feb. 16, 1999**

[54] INK-JET PRINTING METHOD AND APPARATUS THEREFOR

[75] Inventors: Kimio Handa, Ogano-machi; Toshio Hagiwara; Tadashi Arai, both of Chichibu, all of Japan

[73] Assignee: Canon Denshi Kabushiki Kaisha, Saitama, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 594,523

[22] Filed: Jan. 31, 1996

[30] Foreign Application Priority Data

Feb. 1, 1995 [JP] Japan ..... 7-015436
Feb. 1, 1995 [JP] Japan ..... 7-015439

[51] Int. Cl.[6] ..... B41J 13/12

[52] U.S. Cl. ..... 347/8

[58] Field of Search ..... 347/4, 8, 37, 101; 101/35; 400/50–59

[56] References Cited

U.S. PATENT DOCUMENTS 4,313,124 1/1982 Hara .
4,345,262 8/1982 Shirato et al. .
4,463,359 7/1984 Ayata et al. .
4,723,129 2/1988 Endo et al. .
4,740,796 4/1988 Endo et al. .
4,927,277 5/1990 Niikawa ..... 400/56
5,126,753 6/1992 Martin et al. ..... 346/1.1

FOREIGN PATENT DOCUMENTS 1219520 9/1989 Japan .
6199006 7/1994 Japan .

*Primary Examiner*—Daniel P. Malley
*Assistant Examiner*—Michael Dalakis
*Attorney, Agent, or Firm*—Fitzpatrick, Cella, Harper & Scinto

[57] ABSTRACT

An ink-jet printing apparatus which is capable of maintaining a predetermined clearance between a printing surface of a printing object and an ink-jet head, includes a printing object mounting portion, on which the printing object is mounted, an ink-jet unit provided so as to be capable of relative movement in an opposing direction with respect to the printing object mounting portion, and mounting an ink-jet head which can oppose the printing surface of the printing object, shifting means for shifting the ink-jet unit mounting portion relative to the printing object mounting portion in the opposing direction, and a clearance adjusting sensor provided at the side of the ink-jet unit mounting portion so as to be capable of contacting the printing surface of the printing object. The shifting means is driven in a direction where the clearance adjusting sensor is caused to to contact the printing surface of the printing object, the shifting means then is driven in the opposite direction when the clearance adjusting sensor comes into contact with the printing surface of the printing object, and relatively shifting the ink-jet unit mounting portion is shifted relative to the printing object mounting portion in a direction where the clearance adjusting sensor moves away from the printing surface of the printing object by a predetermined magnitude.

31 Claims, 22 Drawing Sheets

INK-JET PRINTING METHOD AND APPARATUS THEREFOR

BACKGROUND OF THE INVENTION

1. Field of the Invention

The present invention relates to an ink-jet printing method and an ink-jet printing apparatus which can maintain a clearance between a printing surface and an ink-jet head and attitude of the ink-jet head, for printing objects of various thickness.

2. Description of the Related Art

In an ink-jet system, ink droplet is ejected from ink ejection openings formed in an ink-jet head toward a printing surface of a printing object for printing a desired information on the printing surface of the printing object. Therefore, it is important for assuring satisfactory printing quality to maintain the clearance between the ink ejection openings of the ink-jet head and the printing surface of the printing object.

Conventionally, since sheet form paper having a thickness of about 0.15 to 0.2 mm or the like is exclusively considered as the printing object, it has been sufficient to mechanically set the clearance between the ink ejection openings of the ink-jet head and the printing surface of the printing object for enabling printing on the paper of the like or typical thickness.

Printing apparatuses having mechanisms for adjusting distance between the ink-jet head and the printing object in accordance with the various kinds of the printing objects also are know. However, the adjustable range is merely set to accomodate the thickness of paper, such as a cardboard or the like, at the maximum. Namely, there has been no printing apparatus which can appropriately adjust the clearance between the ink-jet head and the printing surface of the printing object for a variety of printing objects, such as timber, resin, metal and so forth.

In the recent years, study has been made to perform printing of desired image information on a cloth or so forth, or to perform application of an etchant on a metal plate and so forth for forming a printing plate or so forth, utilizing the feature of an ink-jet system, with timber, resin or metal.

To perform ink-jet printing for such wide variety of printing objects, it is inherently required to provide a mechanism for adjusting the clearance between the ink ejection opening of the ink-jet head and the printing surface of the printing objects. In view of this, as is well known from Japanese Patent Application Laid-open No. 219520/1989, there have been proposed ink-jet printing apparatuses which incorporate mechanisms for adjusting clearances between the ink ejection openings of the ink-jet head and the printing surface of the printing objects.

However, in the case of the ink-jet printing apparatus disclosed in Japanese Patent Application Laid-open No. 219520/1989, a sensor for adjustment of the clearance is constantly held in contact with the printing surface of the printing object, which may form scratch lines or stain the printing surface in some case.

On the other hand, conventional ink-jet printing apparatuses may perform printing or printing objects having a uniform thickness. Thus, for a printing object which has a variable thickness, such as a wedge shaped printing object, printing on the printing surface has been considered impossible unless a certain jig is employed.

Furthermore, in the case of special printing objects other than paper, such as timber, metal and so forth, the operator has to position the printing object relative to a predetermined position of the ink-jet printing apparatus. However, conventional ink-jet printing apparatuses have not been designed in consideration of such special printing objects, and thus have no appropriate positioning device. Therefore, some measurement has been required.

SUMMARY OF THE INVENTION

It is therefore an object of the present invention to provide an ink-jet printing method and an ink-jet printing apparatus which can maintain a predetermined clearance between the ink-jet head of an ink-jet unit and a printing surface of a printing object for printing objects having a wide variety of thicknesses.

Another object of the present invention is to provide an ink-jet printing apparatus which can initiate a printing operation when the printing object is constantly positioned at a predetermined position.

In accordance with the first aspect of the invention, an ink-jet printing method for performing printing of a predetermined information on a printing surface of a printing object employing a printing apparatus comprising;

a printing object mounting portion, on which the printing object is mounted, an ink-jet unit mounting portion, on which an ink-jet head opposing the printing object is mounted, shifting means for relatively shifting the ink-jet unit mounting portion and the printing object mounting portion in opposing directions, a clearance adjusting sensor provided at the side of the ink-jet unit mounting portion so as to be capable of contacting the printing surface of the printing object, the method comprising: the steps of driving the shifting means in a direction where the clearance adjusting sensor is caused to contact the printing surface of the printing object, thus contacting the clearance adjusting sensor with the printing surface of the printing object;

driving the shifting means in an opposite direction at a timing where the clearance adjusting sensor comes into contact with the printing surface of the printing object, relatively shifting the ink-jet unit mounting portion and the printing object mounting portion along a direction where the clearance adjusting sensor moves away from the printing surface of the printing object in a predetermined magnitude; and relatively shifting the printing object mounting portion and the ink-jet unit mounting portion along a direction parallel to the printing surface of the printing object when the clearance adjusting sensor is shifted away from the printing surface of the printing object by a predetermined magnitude so as to perform printing of the predetermined information on the printing surface of the printing object.

Here, the shifting means can relatively shift the printing object mounting portion in parallel in the opposing direction to the ink-jet unit mounting portion. Also, the shifting means can tilt the printing object mounting portion in the width direction thereof.

In the preferred construction, the clearance adjusting sensor includes a lever projecting toward the printing surface of the printing object at one end side, biasing means for biasing the one end of the lever toward the printing surface of the printing object, a switch for detecting displacement of the other end side of the lever beyond a predetermined magnitude against the biasing means. The clearance adjusting sensor can be shifted along the width direction of the printing object mounting portion. In the alternative, two clearance adjusting sensors each provided so as to be capable of shifting along the width direction of the printing object mounting portion.

The method may further comprise a step of driving the shifting means for setting a predetermined clearance between the ink-jet unit mounting portion and the printing object mounting portion, whereby the shifting means is driven in a direction where the clearance adjusting sensor is caused to contact the printing surface of the printing object from the condition where the clearance between the ink-jet unit mounting portion and the printing object mounting portion is set at the predetermined value.

According to the second aspect of the invention, an ink-jet printing apparatus comprises:

a printing object mounting portion, on which the printing object is mounted;

an ink-jet unit mounting portion provided so as to be capable of relative shifting in opposing directions with respect to the printing object mounting portion, and mounting an ink-jet head which can oppose the printing surface of the printing object;

shifting means for relatively shifting the ink-jet unit mounting portion and the printing object mounting portion in opposing directions;

a clearance adjusting sensor provided at the side of the ink-jet unit mounting portion so as to be capable of contacting the printing surface of the printing object;

control means for driving the shifting means in a direction where the clearance adjusting sensor is caused to contact the printing surface of the printing object, driving the shifting means in the opposite direction at a timing where the clearance adjusting sensor comes into contact with the printing surface of the printing object, and relatively shifting the ink-jet unit mounting portion and the printing object mounting portion along a direction where the clearance adjusting sensor moves away from the printing surface of the printing object by a predetermined magnitude;

scanning means for relatively shifting the printing object mounting portion and the ink-jet unit mounting portion along a direction parallel to the printing surface of the printing object.

Here, it is effective that the shifting means can relatively shift the printing object mounting portion in parallel in the opposing direction to the ink-jet unit mounting portion, or can tilt the printing object mounting portion along the width direction thereof.

The clearance adjusting sensor may include a lever projecting toward the printing surface of the printing object at one end side, biasing means for biasing the one end of the lever toward the printing surface of the printing object, and a switch for detecting displacement of the other end side of the lever beyond a predetermined magnitude against the biasing means. The clearance adjusting sensor may be shifted along the width direction of the printing object mounting portion. In the alternative, two clearance adjusting sensors each may be provided so as to be capable of shifting along the width direction of the printing object mounting portion.

Also, the ink-jet printing apparatus may further comprise initial setting means for driving the shifting means for setting a predetermined clearance between the ink-jet unit mounting portion and the printing object mounting portion, and the control means drives the shifting means along a direction where the clearance adjusting sensor is caused to contact the printing surface of the printing object from the condition where the clearance between the ink-jet unit mounting portion and the printing object mounting portion is set at the predetermined value by the initial setting means. In this case, the initial setting means may be a reference position detecting sensor holding the mechanical position of the shifting means at a predetermined position.

With the second aspect of the present invention, the control means relatively shifts the ink-jet unit mounting portion and the printing object mounting portion by driving the shifting means along a direction where the clearance adjusting sensor is caused to contact the printing surface of the printing object. Then, the control means drives the shifting means in the opposite direction at a timing where the clearance adjusting sensor comes into contact with the printing surface of the printing object and relatively shifts the ink-jet unit mounting portion and the printing object mounting portion in along a direction where the clearance adjusting sensor moves away from the printing surface of the printing object by a predetermined magnitude.

In this, manner the ink-jet unit and the printing surface of the printing object are set with a predetermined clearance. In conjunction therewith, the clearance adjusting sensor is held in a non-contact state with respect to the printing surface of the printing object. At this condition, the printing object mounting portion and the ink-jet unit mounting portion are relatively shifted along the direction parallel to the printing to print the predetermined information on the printing surface of the printing object.

Here, in the case of the printing object, where the surface contacted to the printing object mounting portion and the printing surface are parallel, by employing the shifting means, the printing object mounting portion can be shifted to relatively shift in parallel in the opposing direction of the ink-jet unit. Thus, upon printing, the relatively shifting printing surface of the printing object and the ink-jet unit mounting portion become parallel. On the other hand, in the case of a printing object in which the surface contacting the printing object mounting portion and the printing portion are relatively tilted in the width direction, the printing object mounting portion which can be titled in the width direction is employed so that the relatively shifting surfaces of the printing surface of the printing object and the ink-jet unit mounting portion become parallel.

On the other hand, when a clearance adjusting sensor including a lever projecting toward the printing surface of the printing object at one end side, biasing means for biasing the one end of the lever toward the printing surface of the printing object, and a switch for detecting displacement of the other end side of the lever beyond a predetermined magnitude against the biasing means, are employed, by driving the shifting means along the direction where the clearance adjusting sensor is caused to contact the printing surface of the printing object, the printing surface of the printing object abuts one end side of the lever against the biasing means to cause displacement of the other end side of the lever. When the other end of the lever is displaced in a magnitude beyond the predetermined magnitude, the switch is turned to output the signal to the control means.

When the printing surface of the printing object is only present at a part in the width direction of the printing object mounting portion, the clearance adjusting sensor is shifted along the width direction of the printing object mounting portion to the position where the printing surface is present. On the other hand, when the printing surface of the printing object is tilted in the width direction, two clearance adjusting sensors are positioned at respective sides in the width direction of the printing object. Then, by tilting the printing object mounting portion, the both side portions in the width direction of the printing objects are contacted with respective clearance adjusting sensors.

On the other hand, when the initial setting means is further provided for setting the predetermined clearance between the ink-jet unit mounting portion and the printing object mounting portion. The control means drives the shifting means along a direction where the clearance adjusting sensor is caused to contact with the printing surface of the printing object from the condition where the clearance between the ink-jet unit mounting portion and the printing object mounting portion is set at the predetermined value by the initial setting means. In this case, the initial setting means may be a reference position detecting sensor holding the mechanical position of the shifting means at a predetermined position. Then, when the initial setting means, the reference position detecting sensor, is employed, the mechanical position of the shifting means is held at the predetermined position on the basis of the output from the reference position detecting sensor.

According to the third aspect of the invention, an ink-jet printing apparatus comprises:

a transporting belt mounting a printing object and scanning the printing object;

belt driving means for driving the transporting belt;

a side surface reference plate provided at one end side in the width direction of the transporting belt against which the side edge portion of the printing object is contactable;

printing object offsetting means for pushing the side edge portion of the printing object on the transporting belt toward the side surface reference plate;

an ink-jet unit mounting portion provided so as to be capable of relative movement in a perpendicular direction with respect to the surface of the transporting belt, and mounting an ink-jet head which can oppose the printing surface of the printing object;

a positioning stopper provided at the side of the ink-jet unit mounting portion so as to be capable of contact with the leading end of the printing object;

stopper driving means for selectively driving the positioning stopper between a projecting position contactable the leading end of the printing object and a retracted position not to contact with the printing object;

shifting means for relatively shifting the ink-jet unit mounting portion and the transporting belt in opposing directions;

a clearance adjusting sensor provided on the side of the ink-jet unit mounting portion so as to be capable of contacting with the printing surface of the printing object; and control means for driving the shifting means in a direction where the clearance adjusting sensor is caused to contact the printing surface of the printing object, driving the shifting means in the opposite direction at a timing where the clearance adjusting sensor comes into contact with the printing surface of the printing object, and relatively shifting the ink-jet unit mounting portion and the transporting belt along a direction where the clearance adjusting sensor moves away from the printing surface of the printing object by a predetermined magnitude.

Here, it is effective that the shifting means may relatively shift the transporting belt in parallel in the opposing direction to the ink-jet unit mounting portion. The clearance adjusting sensor may include a lever projecting toward the printing surface of the printing object at one end side, biasing means for biasing the one end of the lever toward the printing surface of the printing object, and a switch for detecting displacement of the other end side of the lever beyond a predetermined magnitude against the biasing means.

Also, the ink-jet printing apparatus may further comprise initial setting means for driving the shifting means for setting a predetermined clearance between the ink-jet unit mounting portion and the transporting belt, and the control means drives the shifting means in a direction where the clearance adjusting sensor is caused to contact the printing surface of the printing object from the condition where the clearance between the ink-jet unit mounting portion and the transporting belt is set at the predetermined value by the initial setting means. In this case, as the initial setting means, a reference position detecting sensor for holding the mechanical position of the shifting means at the predetermined position may be included.

It should be noted that the ink-jet head may generate bubble utilizing thermal energy and thereby ejects ink.

With the third aspect of the invention, by switching the positioning stopper to the projecting position by the stopper driving means, the transporting belt is shifted by the belt driving means to abut the leading end of the printing object to the positioning stopper. Then, by actuating the printing object offsetting means to push the side edge surface of the printing object onto the side surface reference plate, the position of the printing object can be set relative to the ink-jet unit. Next, the control means drives the shifting means in the direction where the clearance adjusting sensor is caused to contact the printing surface of the printing object to relatively shift the ink-jet unit mounting portion and the transporting belt. Then, the control means drives the shifting means in the opposite direction at a timing where the clearance adjusting sensor comes into contact with the printing surface of the printing object and relatively shifts the ink-jet unit mounting portion and the printing object mounting portion along a direction where the clearance adjusting sensor moves away from the printing surface of the printing object by a predetermined magnitude.

In this, manner the ink-jet unit and the printing surface of the printing object can be set at the predetermined distance. In conjunction therewith, the clearance adjusting sensor is held in non-contact condition with the printing surface of the printing object. At this condition, the positioning stopper is switched in the retracted position to perform printing of the predetermined information on the printing surface of the printing object.

Here, in the case of the printing object, where the surface to contact with the printing object mounting portion and the printing surface are parallel, by employing the shifting means, shifted the printing object mounting portion to relatively shift in parallel in the opposing direction of the ink-jet unit. Thus, upon printing, the relatively shifting surface of the printing surface of the printing object and the ink-jet unit mounting portion become parallel.

On the other hand, when a clearance adjusting sensor including a lever projecting toward the printing surface of the printing object at one end side, biasing means for biasing the one end of the lever toward the printing surface of the printing object, and a switch for detecting displacement of the other end side of the lever beyond a predetermined magnitude against the biasing means, are employed, by driving the shifting means in the direction where the clearance adjusting sensor is caused to contact with the printing surface of the printing object, the printing surface of the printing object abuts one end side of the lever against the biasing means to cause displacement of the other end side of the lever. When the other end of the lever is displaced by a magnitude beyond the predetermined magnitude, the switch is turned to output a signal to the control means.

When initial setting means is further provided for setting the predetermined clearance between the ink-jet unit mounting portion and the printing object mounting portion, the control means mounting portion, and the control means drives the shifting means along a direction to contact the clearance adjusting sensor to the printing surface of the printing object from the condition where the clearance between the ink-jet unit mounting portion and the printing object mounting portion is set at the predetermined value by the initial setting means. In this case, the initial setting means may be a reference position detecting sensor holding the mechanical position of the shifting means at a predetermined position. Then, when the initial setting means, the reference position detecting sensor, is employed, the mechanical position of the shifting means is held at the predetermined position on the basis of the output from the reference position detecting sensor.

When the ink-jet head which generates bubble utilizing thermal energy and thereby ejects ink, is employed, at least one drive signal which can cause abrupt temperature elevation beyond a film boiling point, corresponding to the printing information is provided to electrothermal transducer to cause heat energy in the electrothermal transducer to cause film boiling at the heat acting surface of the ink-jet head. Thus, bubbles corresponding to the drive signal in one-by-one basis can be generated. By growth and shrink of the bubble, ink is ejected from the ink ejection openings of the ink-jet head to form at least one ink droplet on the printing surface of the printing object.

According to the present invention, the shifting means is driven along a direction where the clearance adjusting sensor is caused to contact the printing surface of the printing object, the shifting means is driven in the reverse direction at the timing where the clearance adjusting sensor contacts the printing surface of the printing object, and thereby the ink-jet unit mounting portion and the printing object mounting portion are relatively shifted along a direction where the clearance adjusting sensor away from the printing surface of the printing object in a predetermined magnitude so as to place the clearance adjusting sensor in non-contact with the printing surface of the printing object. Thereafter, the ink-jet unit mounting portion and the printing object mounting portion are relatively shifted along the direction parallel to the printing surface of the printing object so as to perform printing of a predetermined information on the printing surface of the printing object. Therefore, with respect to the printing surface of printing objects having different thicknesses, the ink-jet head of the ink-jet unit and the printing surface of the printing object can be accurately maintained at the predetermined distance. Therefore, an ink-jet printing method and apparatus which can achieve high quality printing, can be realized.

On the other hand, by contacting the positioning stopper to the leading end of the printing object, and at this condition, the side edge portion of the printing object is aligned to one end side in the width direction of the transporting belt, the attitude of the printing object relative to the ink-jet unit can be maintained constant. Therefore, printing can be accurately performed at the predetermined region on the printing surface.

Furthermore, even for a wedge shaped panel which gradually varies the thickness along the width direction of the printing object, since the printing object mounting portion can be tiled in the width direction to be parallel to the scanning plane of the ink-jet unit, printing operation can be performed without causing any problem.

In addition, since the clearance adjusting sensor can be maintained in non-contact state relative to the printing surface of the printing object during printing operation, the possibility of damaging the printing surface by the clearance adjusting sensor will never be caused.

BRIEF DESCRIPTION OF THE DRAWINGS

The present invention will be understood more fully from the detailed description given herebelow and from the accompanying drawings of the preferred embodiment of the invention, which, however, should not be taken to be limiting to the present invention, but are for explanation and understanding only.

In the drawings.

DESCRIPTION OF THE PREFERRED EMBODIMENT

The present invention will be discussed hereinafter in detail in terms of the preferred embodiments with reference to the accompanying drawings. In the following description, numerous specific details are claimed in order to provide a thorough understanding of the present invention. It will be obvious, however, to those skilled in the art that the present invention may be practiced without these specific details. In other instances, well-known structures are not shown in detail in order not to unnecessarily obscure the present invention.

At first, one embodiment of an ink-jet printing apparatus in accordance with the present invention, which corresponds to the second aspect claimed above, will be discussed with reference to FIGS. 1 to 14.

Figure 1:
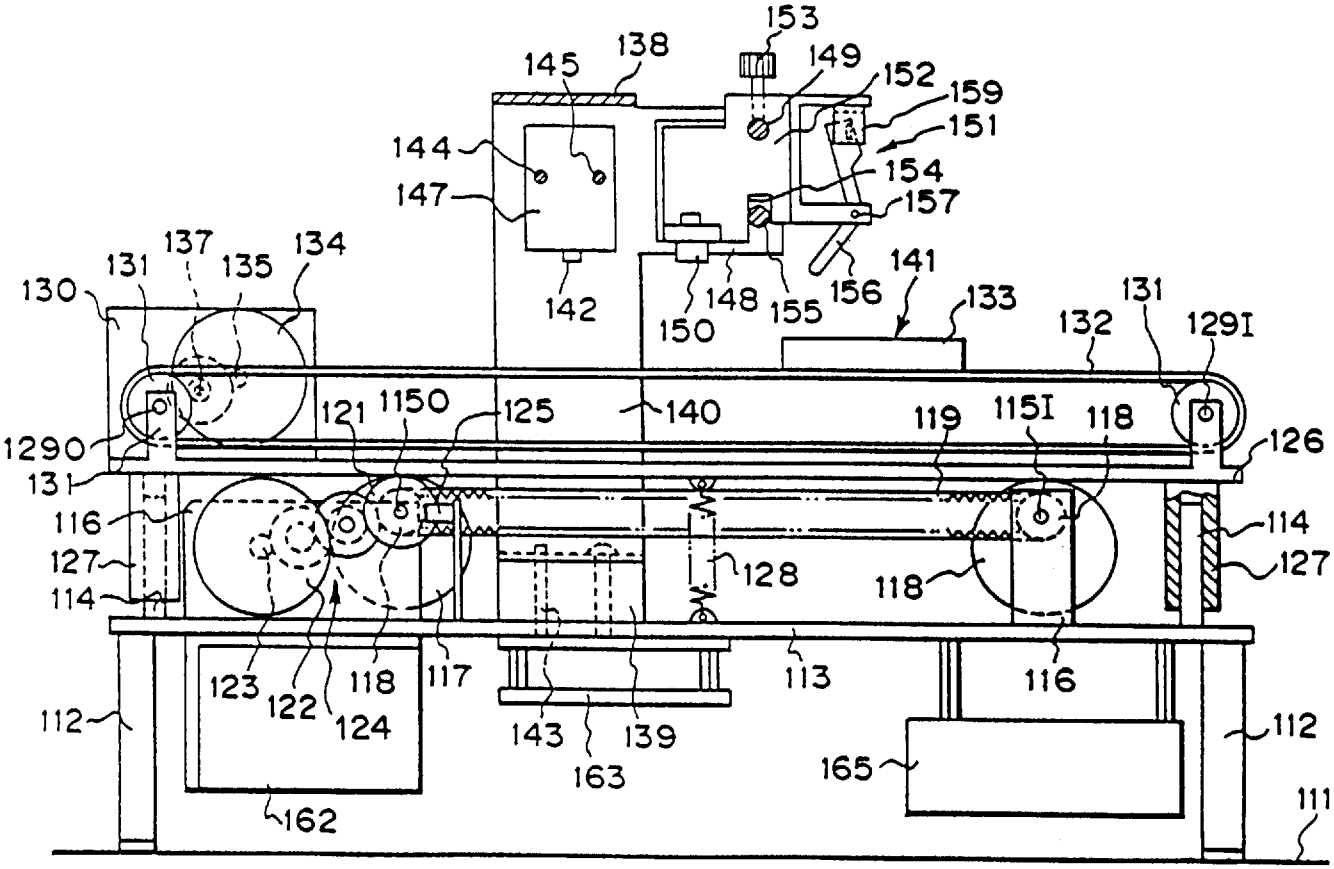
FIG. 1 is a partially cut-out side elevation showing general construction of one embodiment of an ink-jet printing apparatus according to the present invention.
Figure 2:
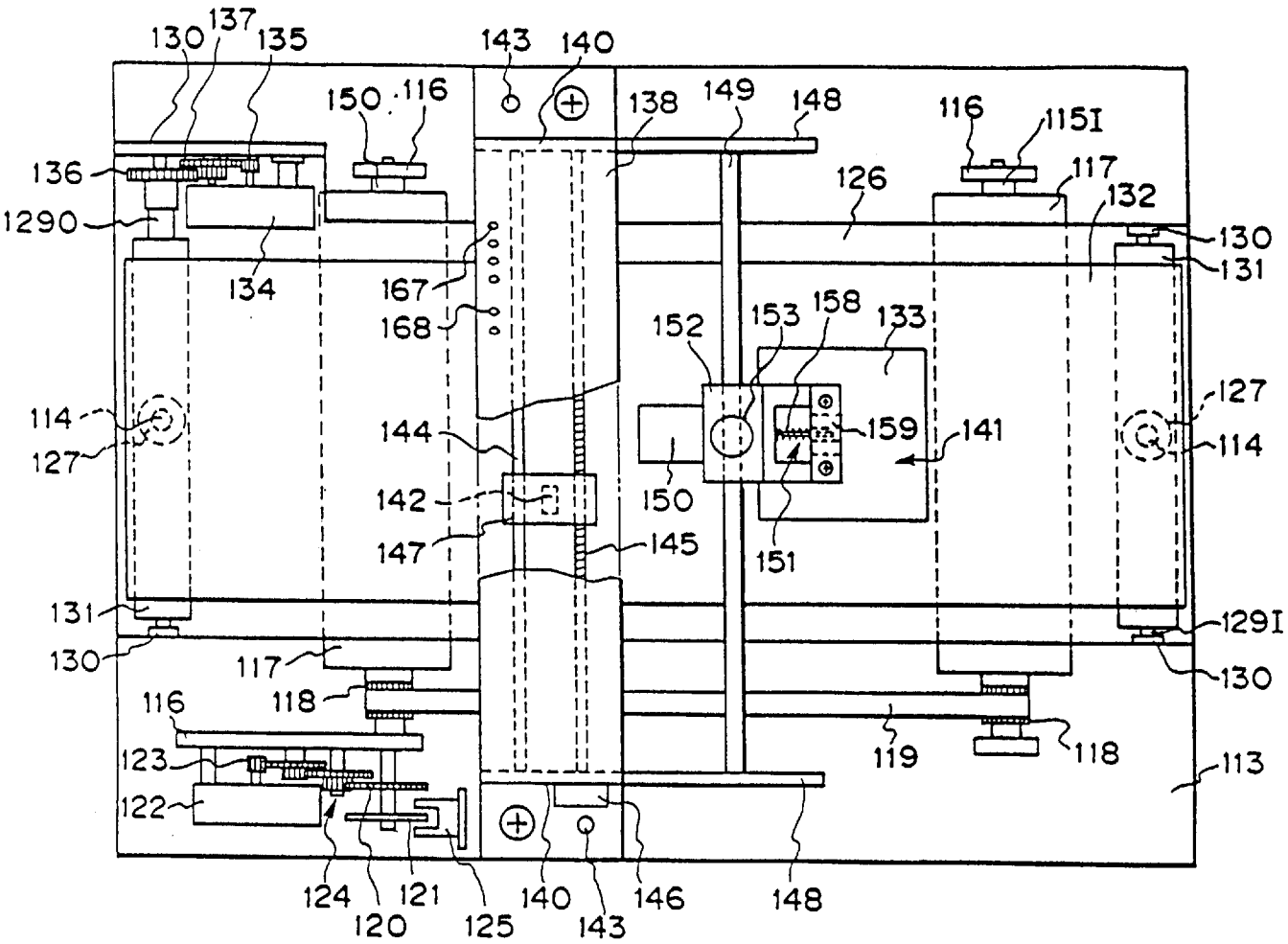
FIG. 2 is a plan view of one embodiment of the ink-jet printing apparatus of FIG. 1.

FIG. 1 shows a general construction of one embodiment of an ink-jet printing apparatus according to the invention, which is adapted to perform desired printing for printing objects having a printing surface substantially parallel to a back side surface, and thus is in a rectangular plate form configuration; and FIG. 2 shows a plan view of one embodiment of the ink-jet printing apparatus of FIG. 1.

At front and rear ends (both ends in left and right direction in the drawings) of a base plate 113 having a plurality of pedestals 112 to be mounted on a mounting surface 111, such as a table or floor, a pair of lifting guide bars 114 extending vertically are provided.

At both of left and right sides of the base plate 113 intersecting with the arrangement direction of the lifting guide bars 114, front and back side cam shaft brackets 116 rotatably supporting a pair of front and rear cam shafts 115I and 1150 are fixed. The pair of front and rear cam shafts 115I and 1150 rotatably supported on a cam shaft bracket 116, are secured on the base plate 113 so that they may be substantially parallel to the surface of the base plate 113. The pair of front and rear cam shafts 115I and 115O are formed with an eccentric cam 117, integrally. In order to make rotational phase of the eccentric cam 117 to be constantly consistent with the cam shaft 115I and 115O, synchronization gears 118 are respectively provided at one end of the pair of front and rear cam shafts 115I and 115O. On the synchronization gear 118, a cogged endless belt 119 is wound therearound. Thus, the height from the surface of the base plate 113 and the upper end of the eccentric cams 117 can be set constantly equal.

It should be noted that between one camshaft 115I and the cam bracket 116 supporting one camshaft 115I, a tension adjusting mechanism (not shown) is provided for relatively shifting the other camshaft 115O in the back-and-forth direction of the base plate 113 with respect to the camshaft bracket 116 for adjusting tension of the cogged belt 119.

On one end side of one camshaft 1150 extending through one camshaft bracket provided at one end side of the base plate 113 and rotatably supported, thereby a rotary plate 121 is provided for detecting a reference position of a cam follower gear 120 and the camshafts 115I and 115O. Also, on the camshaft bracket 116, a stepping motor 122 (hereinafter referred to as camshaft driving motor) which can be variable of driving direction between forward and reverse direction is mounted for driving the camshafts 115I and 115O. Furthermore, a reduction gear train 124 for transmitting a rotational force of a camshaft driving gear 123 is integrated with the camshaft driven motor 122. On the outer peripheral portion of the rotary plate 121, a cut-out (not shown) is formed at one portion. An reference position detecting sensor 125 for detecting the cut-out on the outer peripheral portion of the rotary plate 121 is mounted on the base plate 113. When the reference point detecting sensor 125 detects the cut-out on the rotary plate 121, the distance from the camshafts 115I and 115O to the upper end surface of the eccentric cam 117 becomes minimum.

Namely, the reference position of the camshafts 115I and 115O is the rotational phase where the distances from the camshafts 115I and 115O to the upper end surface of the eccentric cam 117 become minimum. At this condition, the camshaft driving gear 123 of the camshaft driving motor 122 rotates in the forward direction to upwardly drive a lifting table 126 which will be discussed later, relative to the base plate 113. Then, the camshaft driving motor 122, the reduction gear train 124, the camshaft driven gear 120, camshafts 115I and 115O and the eccentric cam 117 form moving means of the present invention.

On the other hand, at both of the front and rear ends of the lifting table 126, mounted on the eccentric cam 117 for slidingly contact with the eccentric cam at the back surface, a lifting guide cylinders 127 which are slidably engaged with the lifting guide rods 114, and which are projected downwardly. On the other hand, between the lifting table 126 and the base plate 113, a tension spring 128 is disposed for biasing the lifting table 126 toward the base plate 113 so as to constantly maintain the lifting table 126 in contact with the eccentric cam 117. Associated with actuation of the camshaft driving motor 122, a pair of front and rear camshafts 115I and 115O are rotated in synchronism with each other. In this, manner the lifting table is lifting up and down along the lifting guide rods 114 on the base plate 113, in FIG. 1.

At both of the front and rear ends of the lifting table 126, pulley shaft brackets 130 for rotatably supporting a pair of front and rear pulley shafts 129I and 129O which extend in parallel to the camshafts 115I and 115O, are respectively secured at both left and right sides of the lifting table 126. On belt pulleys 131 respectively formed integrally with the pulley shafts 129I and 129O, an endless transporting belt 132 is wound around. A printing object 133 is mounted on the predetermined position of the transporting belt 132. Namely, the transporting belt 132 forms a printing object mounting portion.

On the pulley shaft brackets 130 supporting one end of one pulley shaft 129O, a stepping motor 134 (hereinafter referred to as pulley shaft driving motor) is mounted for driving the pulley shaft 129I and 129O. Also, a reduction gear 137 is rotatably provided for transmitting the rotational force of the pulley shaft driving gear which is integral with the pulley shaft driving motor 134 to the pulley shaft driven gear 136.

Accordingly, when the pulley shaft driving motor 134 is actuated, one pulley shaft 129I is driven. Associating with this, the transporting belt 132 is circulated in clockwise direction in FIG. 1 to transport the printing object 133 mounted on the other side (right side in FIG. 1) of the lifting table 126 toward one end side (left side in the drawing).

It should be noted that between the other pulley shaft 129I and the pulley shaft bracket 130 supporting the other pulley shaft 129I, a tension adjusting mechanism (not shown) is disposed for shifting the other pulley shaft 129O relative to the pulley shaft bracket 130 in the back-and-forth direction of the base plate 113, for adjusting the tension of the transporting belt 132.

To both of the left and right side ends of a top beam 138 which extends laterally over the center portion of the lifting table 126, the upper end of a column 140 which is detachably secured to the base plate 113 at the lower end via an adjusting block 139 by means of screws, are connected integrally. In the shown embodiment, in order to maintain a clearance between a printing surface 141 of the printing object 133 and the ink-jet head 142 constant, the camshafts 115I and 115O are driven to rotate to adjust the eccentricity of the eccentric cam 117. When printing is performed for a printing object 133 which varies in thickness, the extent of variation of which can be absorbed only by the eccentricity of the camshafts 115I and 115O, the adjusting block 139 can be exchanged to have one appropriate thickness. Therefore, so that the position of the column 140 relative to the base plate 113 can be accurately positioned, a positioning pin 143 is interposed between the base 113 and the column 140.

To the upper ends of a pair of left and right columns 140, both ends of a unit guide bar 144 and a primary scan threaded shaft 145 are secured, respectively. Both ends of the primary scan threaded shaft 145 are rotatably supported with respect to the column 140. To one end of the primary scan threaded shaft 145, a stepping motor 146 (hereinafter referred to as primary scan threaded shaft driving motor in the disclosure) is connected. An ink-jet unit, to which the primary scan threaded shaft 145 is engaged and through which the unit guide bar 144 extends, is reciprocally driven toward left and right about the transporting belt 132 along the unit guide shaft 144 by driving of the primary scan threaded shaft 145 according to actuation of the primary scan threaded shaft driving motor 146. Namely, the top beam 138, the columns 140, the unit guide bar 144 and the primary scan threaded shaft 145 form an ink-jet unit mounting portion of the present invention.

It should be noted that the ink-jet unit 147 in the shown embodiment is loaded with an ink-jet head 142, in which a plurality of downwardly directed ink ejection openings (not shown) are arranged in back-and forth direction (left and right direction in the drawing) at the lower end thereof. For example, a known ink-jet head, such as that disclosed in Japanese Patent Application Laid-open Publication No. 199006/1994, may be employed. In this case, an ink tank (not shown) for supplying ink to the ink-jet head 142 is exchangeably mounted to the ink-jet unit 147. In the alternative, the ink-jet head 142 may be exchangeably mounted on a top beam 138 or the column 140. When the ink tank is mounted on the ink-jet unit, the ink tank is designed to be separable from the ink-jet head assembly, or, in the alternative, the ink tank may be formed integrally with the ink-jet head.

Figure 3:
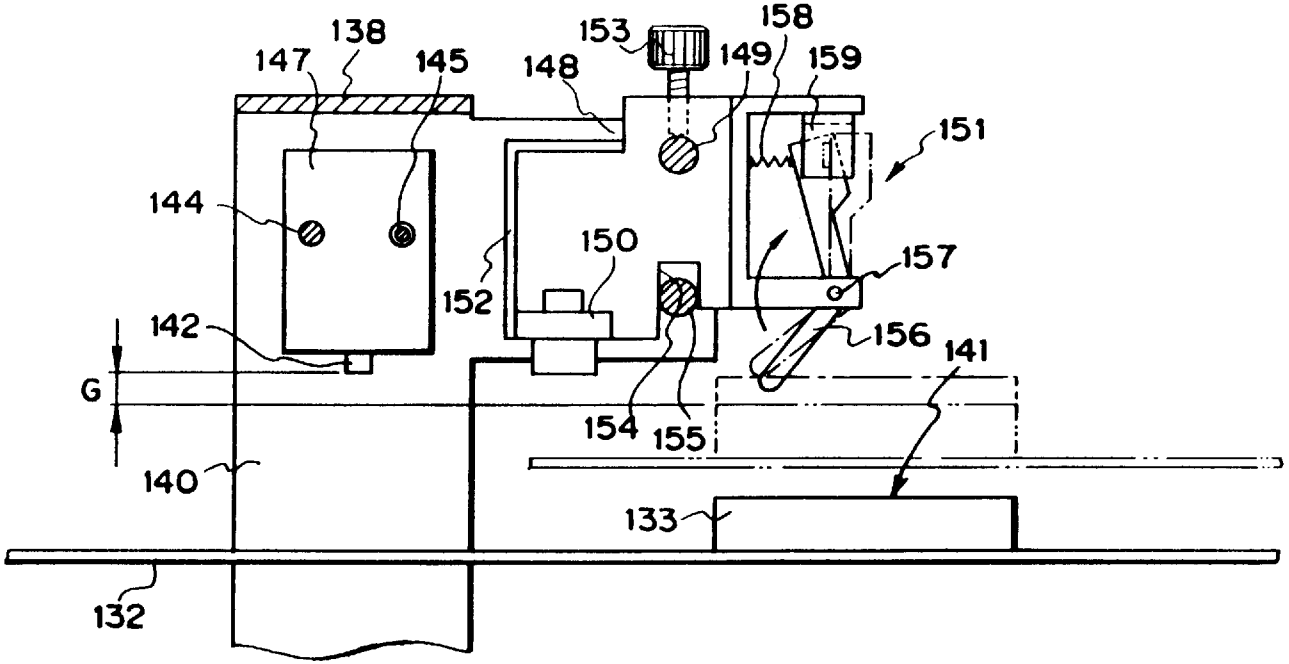
FIG. 3 is an extracted enlarged section of an ink-jet unit of FIG. 1.

As shown in FIG. 2 and in FIG. 3 which illustrates the upper portion of the column 140, to a guide bar support arm 148 projected from the other side of the lifting table 126 from the upper end of the column 140, both ends of a sensor holder guide bar 149 parallel to the camshafts 115I and 115O are connected. Through the sensor holder guide bar 149, a sensor holder 152, on which a media leading end detecting sensor 150 for detecting a fed in printing object 133 and a clearance adjusting sensor 151 for appropriately adjusting the clearance between the ink-jet head 142 and the printing object are mounted at front and rear portions, is extended. To the upper end of the sensor holder 152, a stopper screw 153 is threaded in to abut with the sensor holder guide bar 149 at the tip end. The stopper screw 153 is adapted to arbitrarily fix the relative position of the sensor holder 152 relative to the sensor holder guide bar 149 along the longitudinal direction. On the other hand, immediately below the sensor holder guide bar 149, rotation preventing bar 155 slidably engaging with a rotation preventing groove 154 formed on the lower end portion of the sensor holder 152 is arranged in parallel to the sensor holder guide bar 149. Both ends of the rotation preventing bar 155 also are integrally connected to the guide bar support arms 148.

Figure 4:
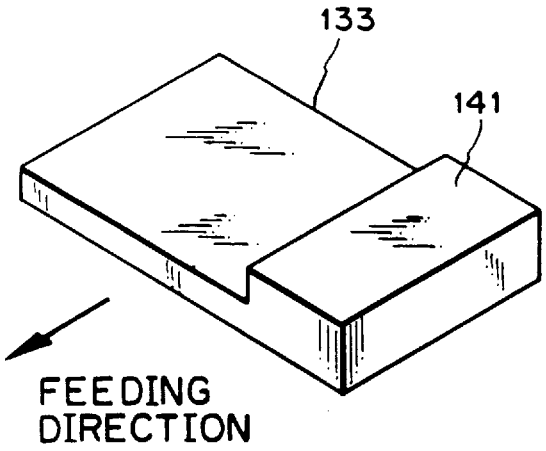
FIG. 4 is a perspective view showing an external appearance of one printing object applicable to one embodiment of the ink-jet printing apparatus of FIG. 1.
Figure 5:
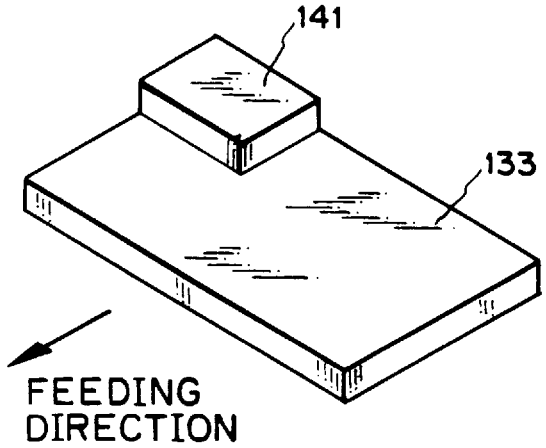
FIG. 5 is a perspective view showing an external appearance of another printing object applicable to one embodiment of the ink-jet printing apparatus of FIG. 1.

In the shown embodiment, since the position of the sensor holder 152 can be moved along the sensor holder guide bar 149, as shown in FIGS. 4 and 5 showing the external appearance of the printing object 133, even when the printing is surface 141 of the printing object 133 to be printed on is projected from the other portion, of the printing object and furthermore the printing surface 141 to be printed or is present only in part in the width direction of the printing object 133, printing on such printing surface 141 can be performed without any problem by shifting the sensor holder 152 immediately above the printing surface 141. Therefore, even for the printing object 133 as illustrated in FIGS. 4 and 5, printing can be performed without causing any difficulty.

In the shown embodiment, the media leading end detecting sensor 150 employs a reflection type photoelectric switch to detect the leading position of the printing object 133 fed into the side of the ink-jet unit 147 in non-contact manner. On the other hand, in the shown embodiment, the clearance adjusting sensor 151 includes the swing lever 156 in a form of a bell crank, a pivot pin 157 pivotally securing the center portion of the swing lever 156 with respect to the sensor holder 152, a tension spring 158 provided between the upper end portion of the swing lever 156 and the sensor holder 152 and biasing the lower end of the swing lever 156 downwardly, namely in the clockwise direction about the pivot pin 157 in FIG. 3, and a sensor switch 159, such as a penetration type photoelectric switch and so forth. Then, against the spring force of the tension spring 158, the upper end of the swing lever 156 is pivoted in the clockwise direction over a predetermined amount to overlap with the sensor switch 159. When the upper end of the swing lever 156 is pivoted away from the sensor switch 159 in a predetermined magnitude, a signal output from the clearance adjusting sensor 151 turns ON.

Thus, since the lower end of the swing lever 156 is in contact with the printing surface 141 of the printing object 133 mechanically, it becomes possible to accurately set the clearance between the printing surface 141 of the printing object 133 and the ink-jet head 142. On the other hand, in the shown embodiment, at a timing where the clearance adjusting sensor 151 is turned ON, forward revolution of the camshaft driving motor 122 is terminated. Subsequently, when the camshaft driving motor 122 is driven in reverse direction for the predetermined amount, the clearance G (see FIG. 3) between the printing surface 141 of the printing object 133 and the ink-jet head 142 can be set at an appropriate distance. By this, the clearance adjusting sensor 151 is designed to temporarily contact the printing surface 141 of the printing object 133.

Figure 6:
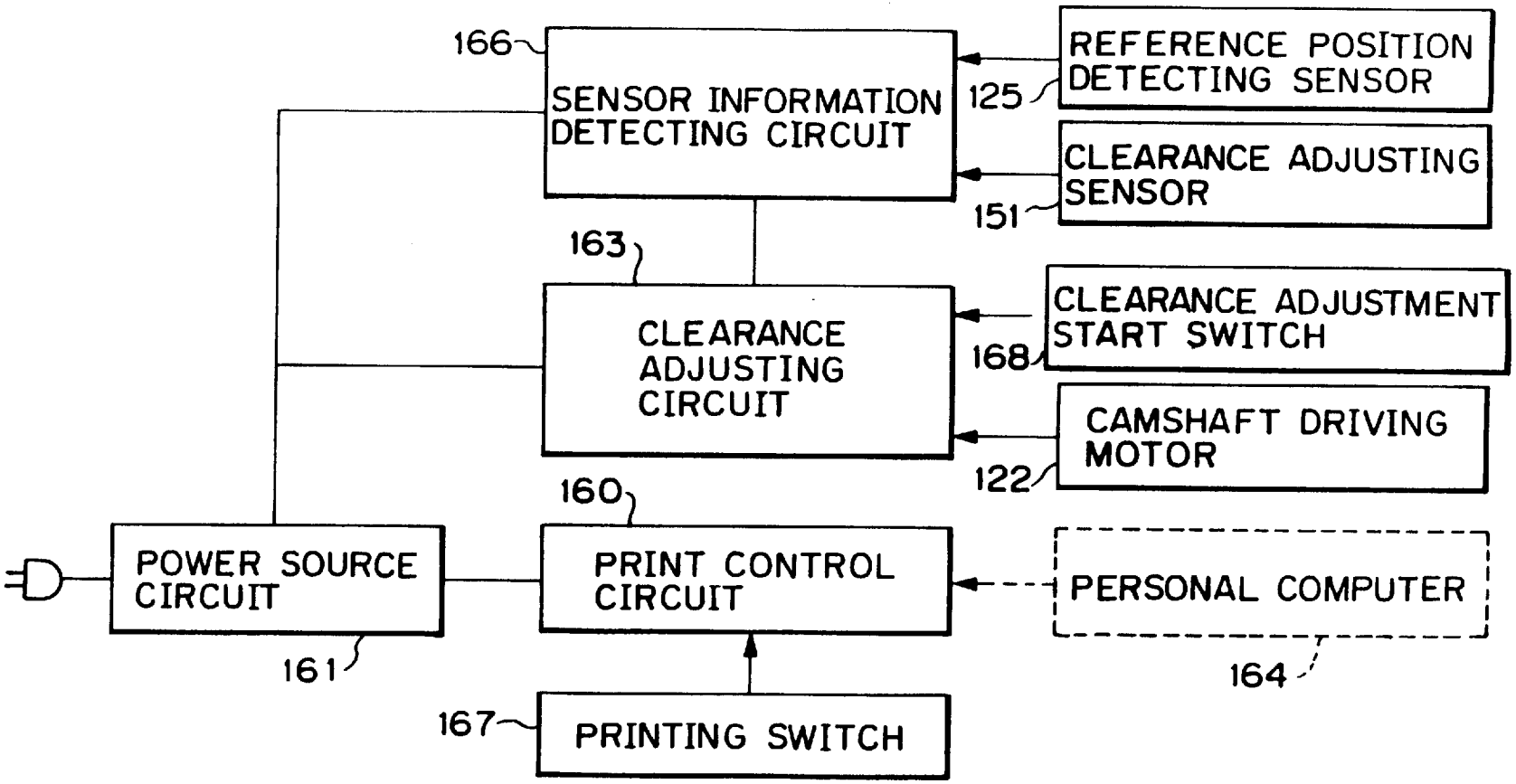
FIG. 6 is a block diagram showing a control system of one embodiment of the ink-jet printing apparatus of FIG. 1.

In order to realize the above-mentioned operation, as shown in FIG. 6, in which a control block of the shown embodiment is illustrated, on the ink-jet unit 147, a print control circuit 160 is provided for controlling operation of the pulley shaft driving motor 134 and the primary scan threaded shaft driving motor 146. On the other hand, at the back side of the base plate 113 are provided a power source unit 162 incorporating a power source circuit 161 for stable power to respective motors 122, 134 and 146, a clearance adjusting circuit 163 for driving the camshaft driving motor 122 in a predetermined operational order, and an interface board for transferring a printing information input to a personal computer 164 or so forth to the print control circuit 160. Then, detection signals from the sensors 125 and 151 are output to the clearance adjusting circuit 163 via the sensor information detecting circuit 166.

It should be noted that, on the upper surface of the top beam 138, a plurality of kinds of switches 167 for printing, and/or a clearance adjustment start switch 168 and so forth, which are to be operated by the operator, are mounted. The printing switches 167 are connected to the printing control circuit 160 together with the medium leading end detection sensor 150, and the clearance adjustment start switch 168 is connected to the clearance adjusting circuit 163.

Figure 7:
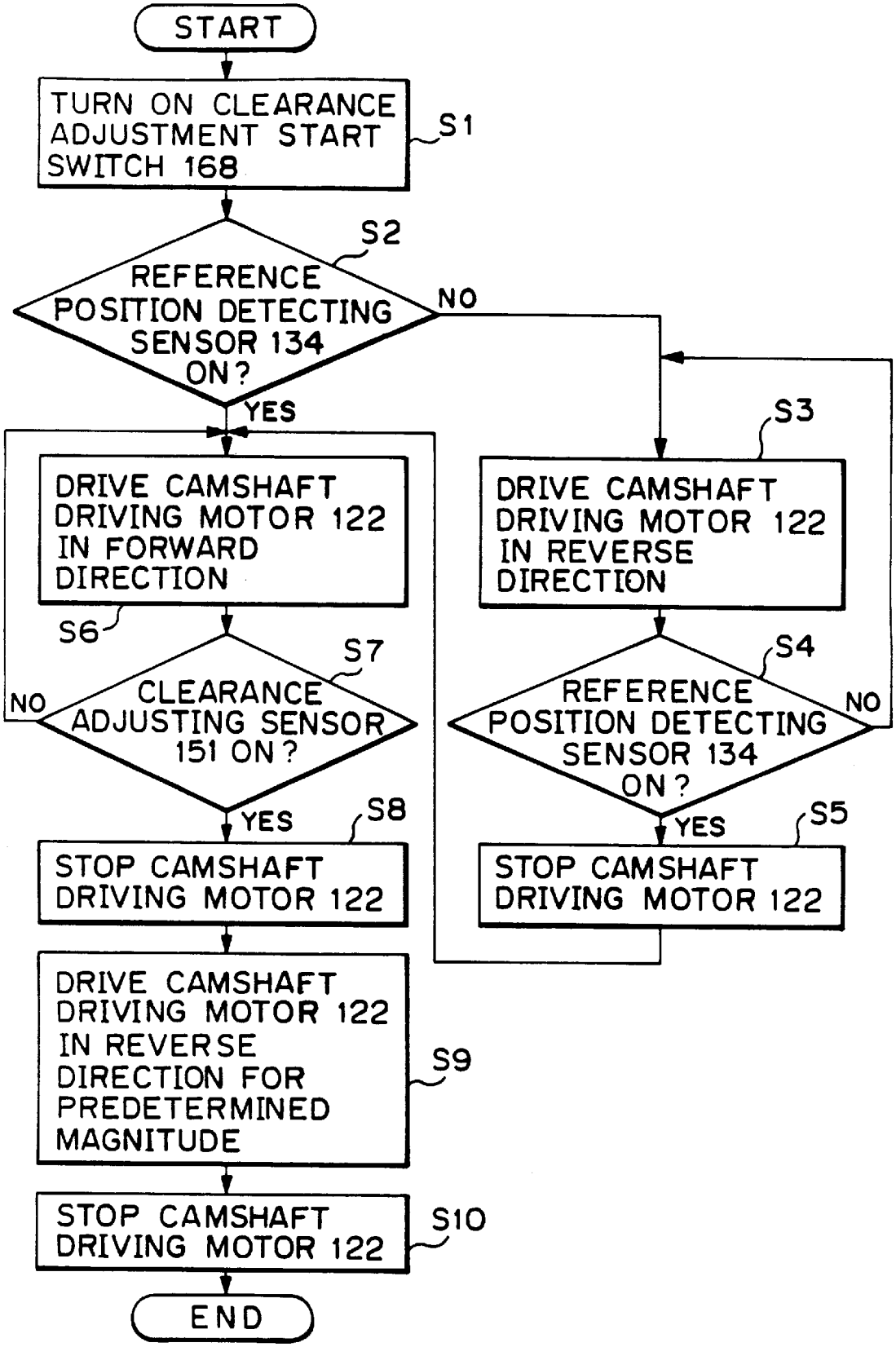
FIG. 7 is a flowchart showing a procedure of a clearance adjusting operation in one embodiment of the ink-jet printing apparatus of FIG. 1.

FIG. 7 shows operational procedure of the shown embodiment. At first, if the operator depresses the clearance adjustment start switch 168 at step S1, a check is made whether the reference position detecting sensor 125 is ON or not at step S2. When judgement is made that the reference position detecting sensor 124 is not in ON state as checked at step S2, the process is advanced to step S3 to drive the camshaft driving motor 122 in reverse direction at step S3. Then, at step S4, a check is again made whether the reference position detecting switch 125 is turned ON or not. If the reference position detecting sensor 125 is not yet turned ON, the process returns to step S3 to maintain driving of the camshaft driving motor 122 in the reverse direction.

When turning ON of the reference point detecting sensor 125 is detected at step S4, driving of the camshaft driving motor 125 in the reverse direction is terminated at step S5. Then, at step S6. forward driving of the camshaft driving motor 122 is initiated. On the other hand, if turning ON of the reference point detecting sensor 125 is detected at step S2, the process jumps to step S6 to initiate driving of the camshaft driving motor 122. Then, at step S7, check is made whether the clearance adjusting sensor 151 is turned ON or not. When judgement is made that the clearance adjusting sensor 151 is not turned ON, the process is returned to step S6 to continue driving of the camshaft driving motor 122 in forward direction.

When turning ON of the clearance adjusting sensor 151 is judged at step S7, driving of the camshaft driving motor 122 in the forward direction is terminated at step 58, and then the camshaft driving motor 122 is driven in the reverse direction for a predetermined magnitude at step S9. Thereafter, at step S10, operation of the camshaft driving motor 122 is stopped for terminating clearance adjustment for the clearance between the ink-jet head and the printing object 133.

Thereafter, the operator depresses the printing switch 167 to actuate the pulley driving motor 134. Then, at a timing where the leading end of the printing object is detected by the media leading end detecting sensor 150, the print control circuit 160 controls operation of the pulley driving motor 134 and the primary scan threaded shaft driving motor 146 for printing the desired image information on the printing surface 141 of the printing object. The printing object, on which printing is completed, is fed out to one end side of the lifting table 126.

It should be noted that when the thickness of the printing object 133 is increased gradually along the scanning direction on the transporting belt driven by the pulley shaft driving motor 134, it is possible that the clearance adjusting sensor 151 is turned ON during printing operation. In such case, it may be impossible to maintain good quality of printing. Therefore, in the shown embodiment, when the clearance adjusting sensor 151 is turned ON during printing operation, driving of the pulley driving motor 134 is terminated to interrupt printing operation in order to prevent the clearance adjusting sensor 151 from being damaged.

The embodiment described above is applicable in the case where the back side surface of the printing object 133 which is in contact with the transporting belt 132 is parallel to the printing surface 141. It is also possible to utilize the present invention even for a printing object 133 which has a thickness that gradually varies in the width direction perpendicular to the feeding direction of the transporting belt 132.

Figure 8:
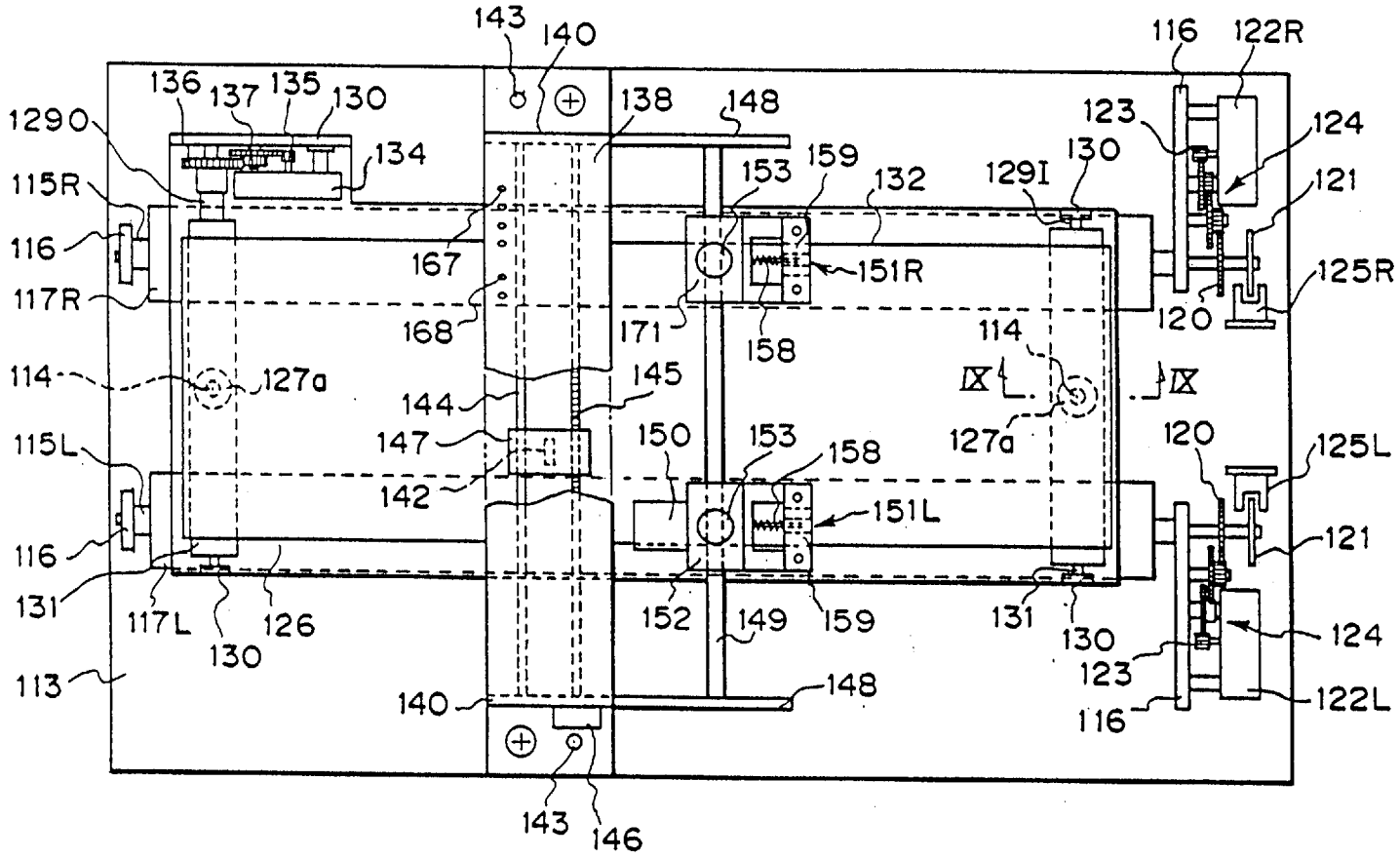
FIG. 8 is a plan view showing a general construction of another embodiment of the ink-jet printing apparatus of the present invention.
Figure 9:
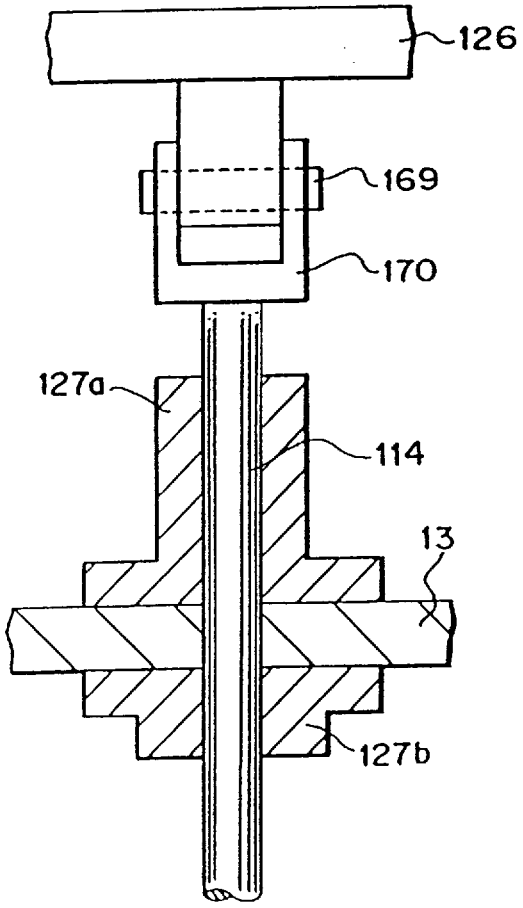
FIG. 9 is a section taken along line IX—IX of FIG. 8.

A plan view of the construction of another embodiment of the present invention is illustrated in FIG. 8, and FIG. 9 shows a section as viewed along the arrow IX—IX of FIG. 8. It should be noted that like components performing like functions may be represented by the same reference numerals and discussion therefor will be omitted. Namely, at both of the front and rear edges at the back side of the lifting table 126, a fork shaped connecting portion 170 which is formed at the upper end portion of the lifting guide bar 114 is rockably pivoted via connecting pins 169 extending in a direction parallel to the transporting direction (left and right direction in the drawing) of the not shown printing object. The front and rear side connecting pins 169 are arranged in alignment. On the other hand, lifting guide cylinders 127*a* and 127*b* (which will be generally represented by reference numeral 127 occasionally) for slidably holding these lifting guide bars 114 are mounted on both the front surface side and back surface side of both the front and rear end portions of the base plate 113. In the shown embodiment, the lifting guide bars 114 are designed to pass through the base plate 113. On both the left and right sides of the base plate intersecting the back-and-forth arranging direction of these lifting guide cylinders 127, the camshaft brackets 116 rotatably supporting a pair of left and right camshafts 115L and 115R opposing across the front and rear lifting guide cylinders 127, are fixed at front and rear sides of the base plate 113. For a pair of left and right camshafts 115L and 115R rotatably supported by the camshaft brackets 116, eccentric cams 117L and 117R are integrally formed.

At one end side of the camshafts 115L and 115R extending through the left and right side camshaft brackets 116 located at one end side of the base plate 113 and rotatably supported therein, camshaft follower gears 120 and rotary discs 121 for respectively detecting a later-mentioned reference position of the camshafts 115L and 115R are coaxially and integrally provided. Also, on these camshaft brackets 116, reversible camshaft driving motors 122L and 122R are mounted for independently driving respective camshafts 115L and 115R. Also, reduction gear trains 124 are rotatably mounted on the camshaft brackets 116 for transmitting rotational force of camshaft driving gears 123 to the camshaft follower gears 120. On the outer periphery of each of the rotary discs 121, a cut-out (not shown) is formed at one position. Reference position detecting sensors 125L and 125R for detecting the cut-outs are mounted on the base plate 113, respectively. When the reference position detecting sensors 125L and 125R detect the cut-outs of the respective discs rotary 121, the distance from the camshafts 115L and 115R and the upper end surfaces of the eccentric cams 117L and 117R becomes minimum.

Namely, the reference position of the camshafts 115L and 115 are rotational phases of the camshafts 115L and 115R where the distance between the camshafts 115L and 115R and the upper end surfaces of the eccentric cams 117L and 117R become minimum. From this condition, the camshaft driving gears 123 of the camshaft driving motors 122L and 122R are driven in forward direction to lift up the lifting table 126 relative to the base plate 113.

Through the sensor holder bar 149 having both ends connected to the support arms 148 of the columns 140, the sensor holders 152 mounting the medium leading end detecting sensor 150 for detecting feeding in of the printing object and the clearance adjusting sensors 151L for appropriately adjusting distances between the printing object positioned at the left side (lower side in FIG. 8) of the lifting table 126 and the ink-jet head 142 at front and rear sides, and an auxiliary sensor holder 171 mounting the clearance adjusting sensors 151R for appropriately adjusting distances between the printing object positioned at right side (upper side in FIG. 8) of the lifting table 126 and the ink-jet head 142, are slidably extended. At the upper ends of the sensor holder 152 and the auxiliary sensor holder 171, stopper screws 153 each having a tip end abutting onto the sensor holder guide 149 are threaded in. By threading the stopper screws 153 to the sensor holder 152, the relative position of the sensor holder 152 relative to the sensor holder guide bar 149 along the longitudinal direction can be arbitrarily fixed. Therefore, the positions of the sensor holder 152 and the auxiliary sensor holder 171 along the sensor holder guide bars 149 can be shifted depending upon the width of the printing object.

In the shown embodiment, at the timing where the clearance adjusting sensors 151L and 151R are turned ON respectively, driving of the camshaft driving motors 122L and 122R in the forward direction is terminated. Then, when the camshaft driving motors 122L and 122R are driven in the reverse direction for a predetermined amount, the distance between the printing surface of the printing object and the ink-jet head 142 becomes appropriate. Namely, in the case where the thickness of the printing object in the lateral direction across the feeding direction of the printing object is varying in a wedge shape, among the clearance adjusting sensors 151L and 151R, the one opposing the thicker portion of the printing object turns ON at an earlier timing and the other one opposing the thinner portion of the printing object turns ON at a later timing. Therefore, about the connecting pin 169, the side of the lifting table corresponding to the thicker side of the printing object is lifted to higher level than the other side to cause tilting of the lifting table 126. Thus, the printing surface of the printing object can be maintained in parallel to the unit guide bar 144 and the primary scan threaded shaft 145.

In the foregoing two embodiments, the height of the ink-jet unit 147 from the base plate 113 is held stationary and the lifting table 126 mounting the printing object 133 is lifted up and down to adjust the clearance between the printing object 133 and the ink-jet head. However, it is also possible to fix the height from the base plate 113 to the upper end surface of the transporting belt 132 and lift the ink-jet unit 147 relative to the base plate 113 to adjust the clearance between the printing object 133 and the ink-jet head.

Figure 10:
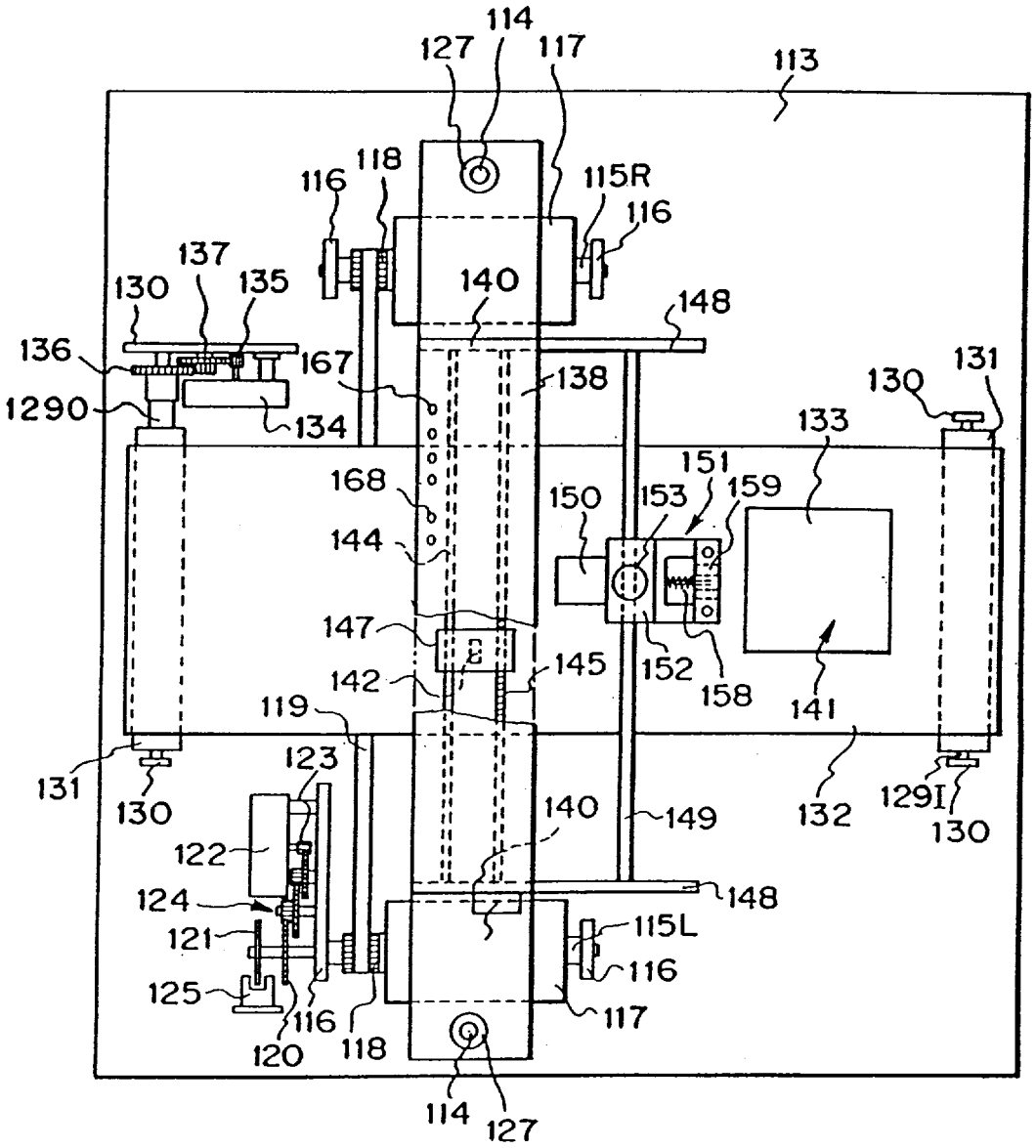
FIG. 10 is a plan view showing a general construction of a further embodiment of the ink-jet printing apparatus of the present invention.

The plan view of a further embodiment of the present invention is illustrated in FIG. 10. In the following discussion, like elements to the former embodiment performing essentially the same function will be identified by same reference numerals and discussion therefor will be omitted. Namely, at both of the front and rear end portions of the base plate 113 (both end portions in the left and right side direction in the drawing), pulley shaft brackets 130 rotatably supporting a pair of front and rear side pulley shafts 129I and 129O are secured at both of the left and right sides of the base plate 113. To the belt pulley 131, the endless transporting belt 132 is wound. The printing object 133 is mounted at the predetermined position of the transporting belt 132. On the other hand, on the pulley shaft driving bracket 130 supporting one end side of the pulley shaft 129O, the pulley driving motor 134 for driving the pulley shafts 129I and 129O is mounted. Also, a reduction gear 137 is provided for transmitting the rotational force of the pulley shaft driving gear 135 integrated with the pulley driving motor 134 to the pulley shaft driven gear 136 provided at one end side of one pulley shaft 129I.

On the lower end of the back side surface of the column extending downwardly from both of left and right side ends of the top beam 138 extending over the transporting belt, the lifting cylinders 127 slidably engaging with a pair of lifting guide bars 114 projecting vertically upward from both of the left and right side end portions of the base plate 113, are projected downwardly. By this, the column 140 can be lifted up and down together with the top beam 138 relative to the base plate 113.

On the other hand, at both of the left and right sides of the base plate 113, the cam brackets 116 rotatably supporting a pair of left and right camshafts 115L and 115R arranged transversely to the pulley shafts 129I and 129O are secured at front and rear sides of the base plate 113. On a pair of left and right side camshafts 115L and 115R rotatably supported on the camshaft brackets 116 in parallel relationship to each other and in parallel relationship with the surface of the base plate 113, eccentric cams 117 are formed integrally. Then, on the synchronization gears 118 respectively provided at one end side of a pair of left and right side camshafts 115L and 115R for constantly matching the rotational phases of the eccentric cams 117 relative to the camshafts 115L and 115R, the endless cogged belt 119 is wound around so as to set the height from the surface of the base plate 113 to the upper surfaces of respective eccentric cams 117 constant.

At one end side of one camshaft 115L rotatably supported on one camshaft bracket 116 provided at one end side of the base plate 113 in condition extending through the latter, the camshaft follower gear 120 and the rotary disc 121 for respectively detecting a later-mentioned reference position of the camshafts 115L and 115R are coaxially and integrally provided. Also, on these camshaft brackets the reduction gear train 124 is rotatably mounted for transmitting rotational force of camshaft driving gear 123 to the camshaft follower gear 120. On the outer periphery of each of the rotary discs 121, a cut-out (not shown) is formed at one position. The reference position detecting sensor 125 for detecting the cut-outs is mounted on the base plate 113. When the reference position detecting sensor 125 detects the cut-outs of the rotary disc 121, the distance from the camshafts 115L and 115R and the upper end surfaces of the eccentric cams 117L and 117R become appropriate.

On the left and right eccentric cams 117, lower end surfaces of the left and right columns 140 are mounted and constantly held in contact by the not shown tension spring. Then, similarly to the embodiment shown in FIGS. 1 to 7, the camshaft driving motor 122 initiates driving in the forward direction from the reference position. Then, by establishing synchronization in rotation of the eccentric cams 117, the distance between the ink-jet head 142 of the ink-jet unit 147 mounted on the top beam 138 and the printing surface 141 of the printing object 133 mounted on the transporting belt 132 is adjusted to a non-contact condition to provide appropriate clearance.

In the embodiment described above, the number of required parts can be reduced since the lifting table 126 becomes unnecessary, Therefore, when the weights of the printing object 133 and/or the transporting device is large, motors having smaller driving force can be employed. Also, while the shown embodiment is applicable for the case where the back side surface of the printing object 133 in contact with the transporting belt 132 and the printing surface 143 are in parallel relationship to each other, similarly to the foregoing embodiment of FIGS. 8 and 9, it is naturally possible to adapt the shown embodiment for a printing object the gradually varies in thickness in the width direction transverse to the transporting direction of the transporting belt 134.

Figure 11:
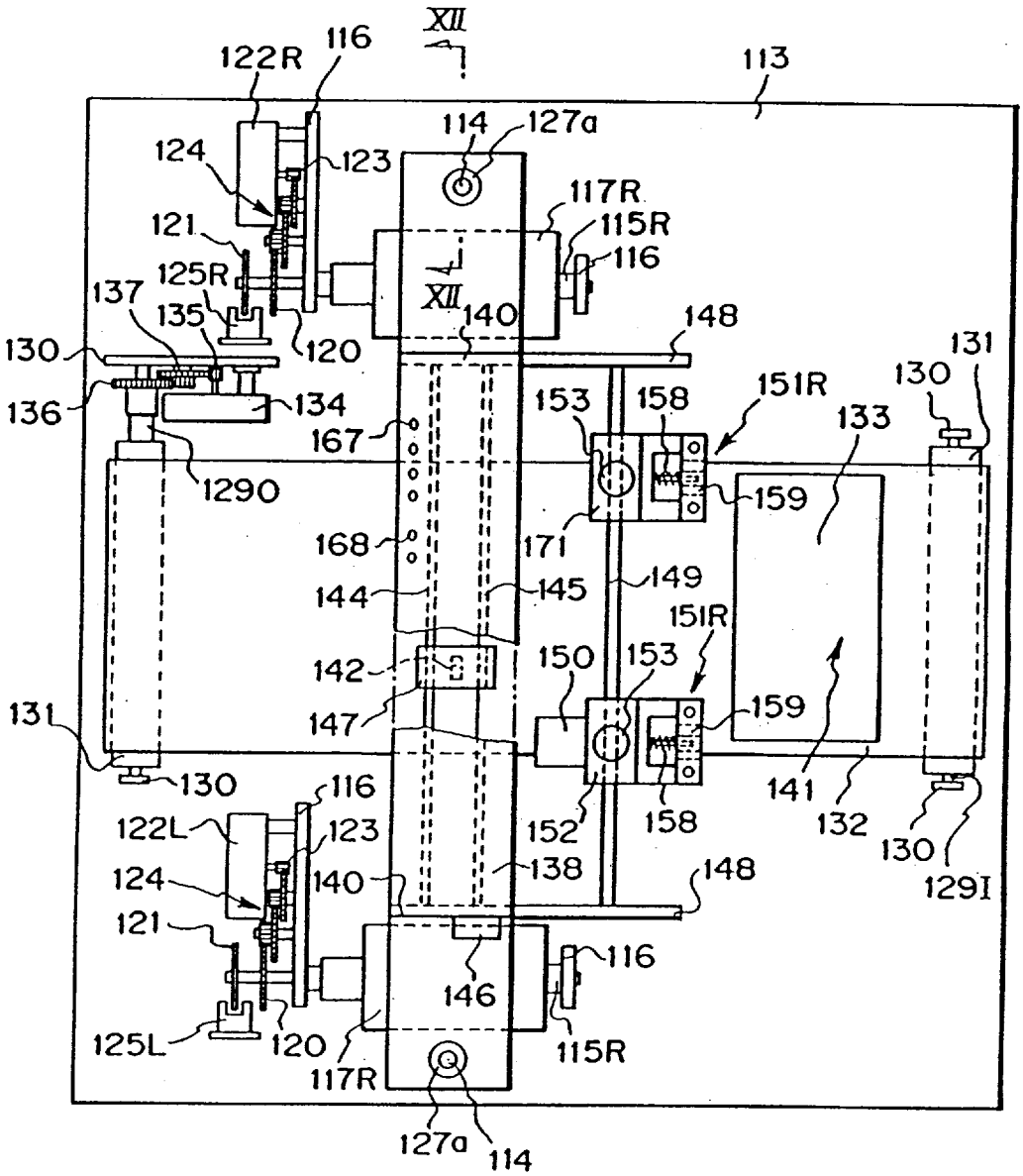
FIG. 11 is a plan view showing a general construction of a still further embodiment of the ink-jet printing apparatus of the present invention.
Figure 12:
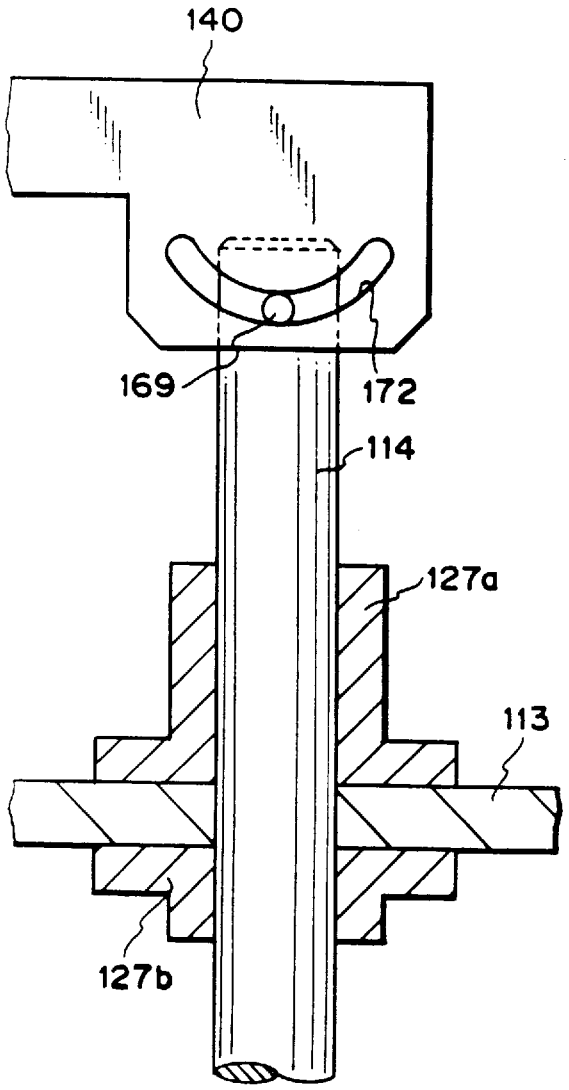
FIG. 12 is a section taken along line XII—XII of FIG. 11.

A plan view of the construction of still further embodiment of the present invention is illustrated in FIG. 11, and FIG. 12 shows a section as viewed along the arrow XII—XII of FIG. 11. In the shown embodiment, at the timing where the clearance adjusting sensors 151L and 151R are turned ON respectively, driving of the camshaft driving motors 122L and 122R in the forward direction is terminated. Then, when the camshaft driving motors 122L and 122R are driven in the reverse direction for a predetermined magnitude, the distance between the printing surface of the printing object and the ink-jet head 142 becomes appropriate. Namely, in the case where the thickness of the printing object in the lateral direction across the feeding direction of the printing object is varying in a wedge shape, among the clearance adjusting sensors 151L and 151R, the one opposing the thicker portion of the printing object turns ON at an earlier timing and the other one opposing the thinner portion of the printing object turns ON at a later timing. Therefore, about the connecting pin 169, the side of the lifting table corresponding to the thinner side of the printing object is lifted to a higher level than the other side to cause tilting of the lifting table 126. Thus, the printing surface of the printing object can be maintained in parallel with the unit guide bar 144 and the primary scan threaded shaft 145.

In the foregoing two embodiments, the height of the ink-jet unit 147 from the base plate 113 is held stationary and the lifting table 126 mounting the printing object 133 is lifted up and down to adjust the clearance between the printing object 133 and the ink-jet head. However, it is also possible to fix the height from the base plate 113 to the upper end surface of the transporting belt 132 and lift the ink-jet unit 147 relative to the base plate 113 to adjust the clearance between the printing object 133 and the ink-jet head.

For this purpose, on the lower end of the column 140, the upper end of the lifting guide bars 114 is rotatably connected via the connecting pin 169. The lower portion of the lifting guide bars 114 are slidably engaged with the lifting guide cylinders 127*a* and 127*b* mounted on both the top side surface and the back side surface of the base plate 113. The connecting pin 169 is movable along an arch-shaped elongated hole 172 formed in the column 140. On the other hand, so as to adapt to the thickness of a printing object exceeding the eccentricity of the eccentric cams 117L and 117R, it is desirable to detachably connect the columns 140 and the top beam 138 via an adjusting block (not shown).

It should be noted that while the foregoing embodiments are designed to transport the printing object 133 by means of the transporting belt, when the weight of the printing object 133 is greater than the weight of the portion including the top beam 138 and the columns 140 moving while holding the ink-jet unit 147, and the ink-jet unit 147, it is possible to transport the top beam and the columns 140 relative to the base plate 113 to permit to use motors with smaller driving force.

Figure 13:
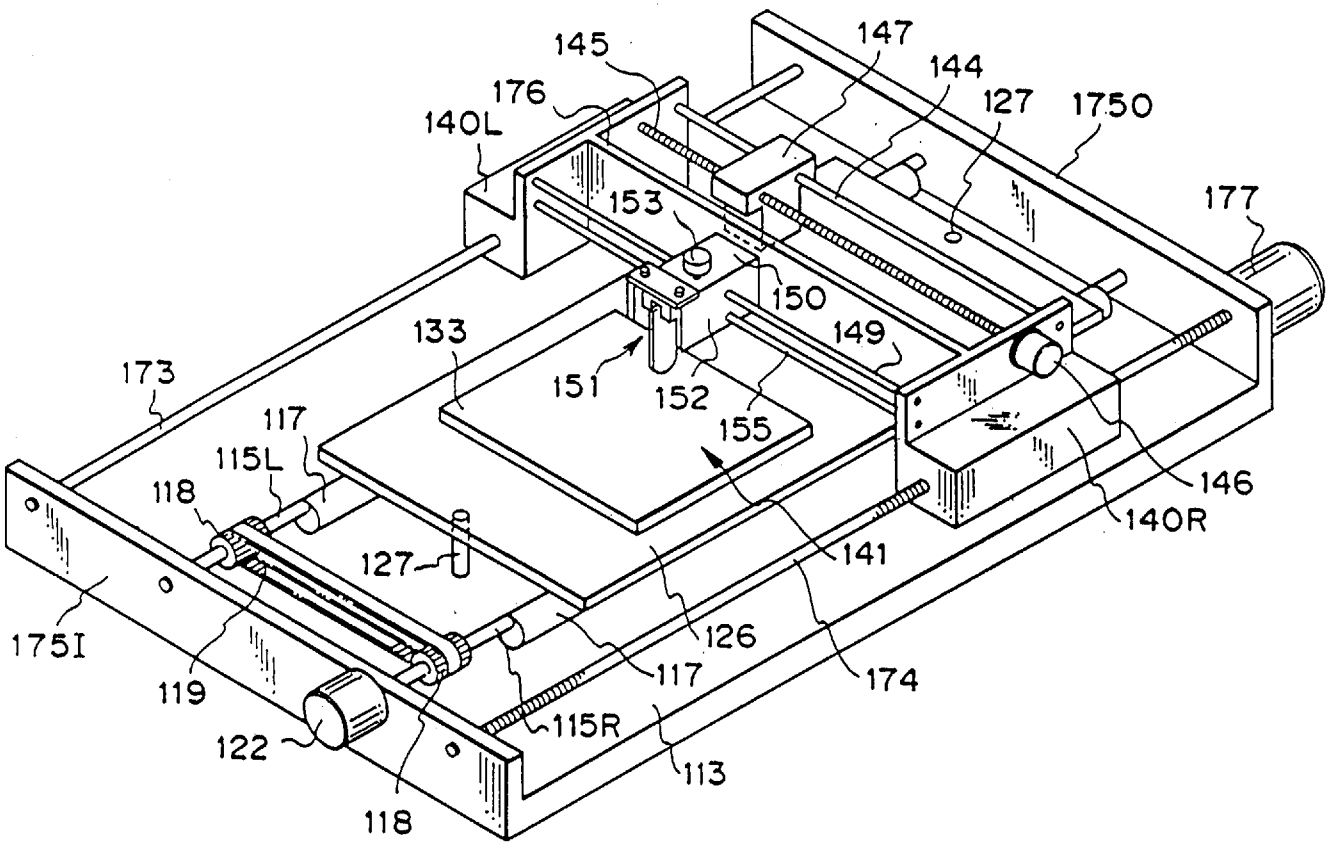
FIG. 13 is a perspective view showing a general construction of yet a further embodiment of the ink-jet printing apparatus of the present invention.

External appearance of a yet further embodiment realizing the foregoing alternation is illustrated in FIG. 13. In the following discussion, like elements accomplishing essentially the same functions as the former embodiments would be identified by same reference numerals and detailed discussion therefor will be omitted. On both of the left and right sides of the base plate 113, a column guide bar 173 and an auxiliary scan threaded shaft 174 are arranged in mutually parallel relationship to each other. The respective end portions are held by a pair of bracket portions 175I and 1750 formed at the front and rear end portions of the base plate 113. On the other hand, on a pair of left and right camshafts 115L and 115R rotatably mounted on a pair of front and rear bracket portions 175I and 175O at both ends in parallel relationship to the column guide bar 173 and the auxiliary scan threaded shaft 174, eccentric cams 117 are formed integrally. On both of the front and rear ends of the lifting table 126 on which the left and right end portions of the eccentric cams 117 are mounted, the lifting guide cylinders 127 slidably engaging with not shown lifting guide bars projecting vertically upward from the base plate 113, are projected vertically downward.

On the synchronization gears 118 respectively provided at one end side of a pair of left and right side camshafts 115L and 115R for constantly matching the rotational phases of the eccentric cams 117 relative to the camshafts 115L and 115R, the endless cogged belt 119 is wound around so as to set the height from the surface of the base plate 113 to the upper surfaces of respective eccentric cams 117 constant. At one end side of one camshaft 115R, the camshaft driving motor 122 mounted on one bracket portion 175I and a not shown reference position detecting sensor for detecting reference position where the distance from the camshafts 115L and 115R to the upper end surface of the eccentric cam 117 are connected. The column 140L slidably engaging with the column guide bar 172 and the column 140R threadedly engaging with the auxiliary scan threaded shaft 174 are integrally connected to each other via a connecting beam 176. To a column driving motor 177 mounted on the other bracket portion 1750, the auxiliary scan threaded shaft 164 is connected. To one end sides of the columns 140L and 140R, both ends of the unit guide bar 144 and the primary scan threaded shaft 145 perpendicularly intersecting with the column guide bar 173 and the auxiliary scan threaded shaft 174 are connected. On the other ends of the columns 140L and 140R, both of the left and right end portions of the sensor holder guide bar 149 and the stopper bar 155 parallel to the unit guide bar 144 and the primary scan threaded shaft 145 are connected.

In this, manner the lifting table 126 is lifted up and down according to operation of the camshaft driving motor 122. Then, the clearance between the printing surface of the printing object 133 mounted on the lifting table 126 and the not shown ink-jet head of the ink-jet unit 147 can be appropriately adjusted by the clearance adjusting sensor 151. The printing operation is performed by shifting of the ink-jet unit 147 in the longitudinal direction by intermittent driving of the column driving motor 177 and shifting of the ink-jet unit in the lateral direction driven by the primary scan threaded shaft driving motor 146.

It should be noted that as means for driving the columns 140L and 140R, a linear pulse motor which has a high end speed response may also be employed.

Figure 14:
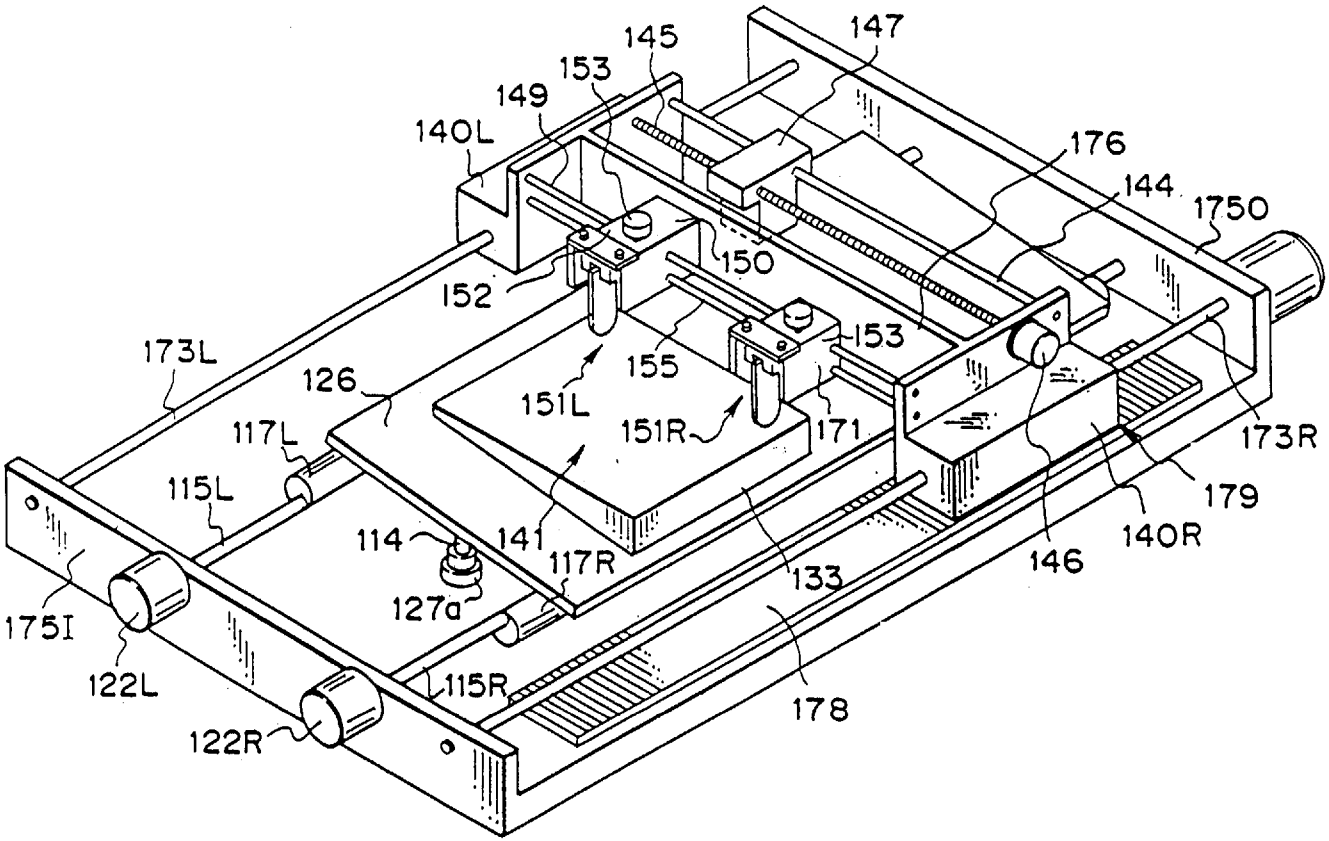
FIG. 14 is a perspective view showing a general construction of a still further embodiment of the ink-jet printing apparatus of the present invention.

A plan view showing the construction of a still further embodiment realizing the foregoing alternation is illustrated in FIG. 14. In the following discussion, like elements accomplishing essentially the same functions as the former embodiments are identified by like reference numerals and detailed discussion therefor will be omitted. On both of the left and right sides of the base plate 113, a pair of column guide bars 173L and 173R are arranged in mutually parallel relationship to each other. The end portions are held by a pair of bracket portions 175I and 175O formed at the front and rear end portions of the base plate 113. On the other hand, on a pair of left and right camshafts 115L and 115R rotatably mounted on a pair of front and rear bracket portions 175I and 175O at both ends in parallel relationship to the column guide bar 173 and the auxiliary scan threaded shaft 174, eccentric cams 117L and 117R are formed integrally. Between both of the front and rear ends of the lifting table 126 on which the left and right end portions of the eccentric cams 117L and 117R are mounted, and the base plate 113, the connecting pin 169 as shown in FIG. 9, the connecting portion 170 of the lifting guide bars 114 (these are not shown in this figure) and the lifting guide cylinders 127*a* and so forth are disposed to permit the lifting table 126 to tilt in left and right direction.

On one end of each camshafts 115L and 115R, camshaft driving motors 122L and 122R respectively mounted on one bracket portions 175I, not shown reference position detecting sensors for detecting the reference position where the distances from the camshafts 115L and 115R and the upper end surfaces of the eccentric cams 117L and 117R become minimum, are connected. On the other hand, between one column 140R and the base plate 113, a linear pulse motor 179 having a stationary coil 178 mounted on the base plate 113 along the column guide bar 173R, is disposed.

In this, manner depending upon the thickness in the width direction of the printing object 133 mounted on the lifting table 126, the lifting table 126 is tilted to maintain the printing surface 141 of the printing object 133 in parallel with the base plate 113, and thus the clearance between the printing surface 141 of the printing object 133 and the not shown ink-jet head of the ink-jet unit 147 can be adjusted appropriately by the clearance adjusting sensor 151L mounted on the sensor holder 152 and the clearance adjusting sensor 151R mounted on the auxiliary sensor holder 171.

It should be noted that while the shown embodiments are designed to scan the ink-jet head unit 147 in the width direction of the printing object 133, it is possible to employ a so-called full-line type ink-jet head, in which the ink ejection openings are arranged over the entire width of the top beam 138 or the connecting beam 176. In the case where a full-line type ink-jet head is employed, the mechanism for scanning the ink-jet head in the width direction of the printing object 133 becomes unnecessary. Also, in the embodiment claimed above, while the lifting table 126 and/or the column 140 is lifted up and down by means of the eccentric cams 117, 117I, 117O, 117L, 117R, it is naturally possible to employ other known lifting mechanisms.

Embodiments of the ink-jet printing apparatus in accordance with the third aspect of the invention will be discussed with reference to FIGS. 15 to 23.

Figure 15:
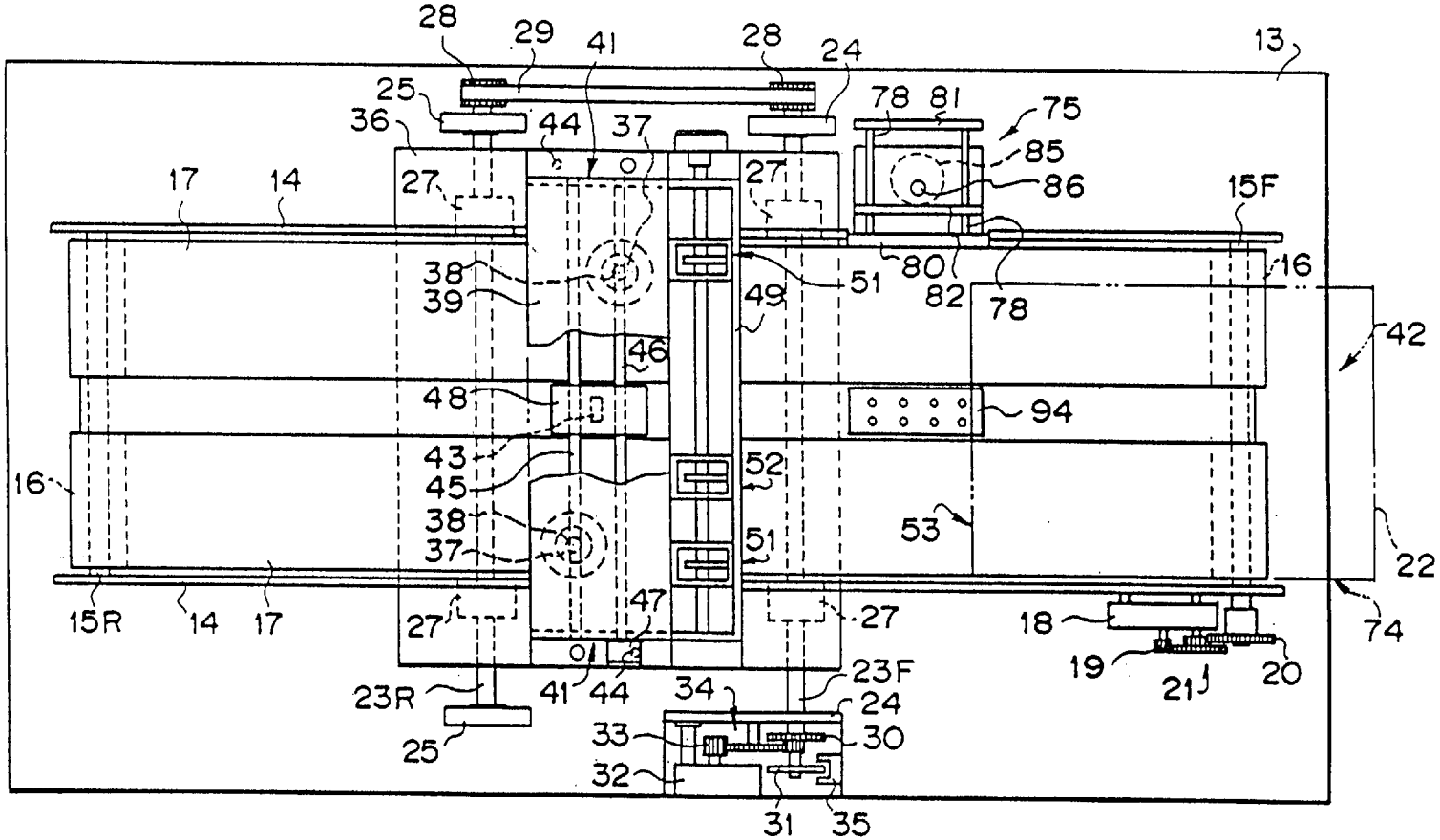
FIG. 15 is a plan view showing a general construction of a yet further embodiment of the ink-jet printing apparatus of the present invention.
Figure 16:
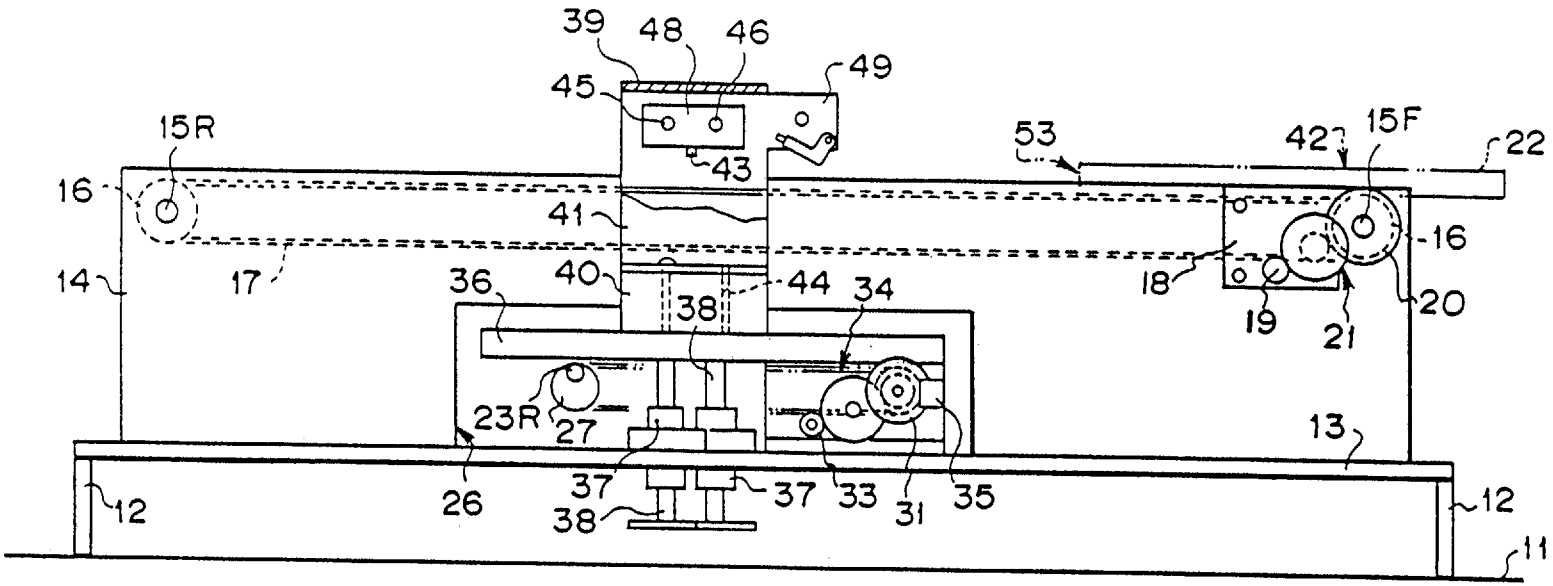
FIG. 16 is a partially sectioned side elevation of the embodiment of the ink-jet printing apparatus of FIG. 15.
Figure 17:
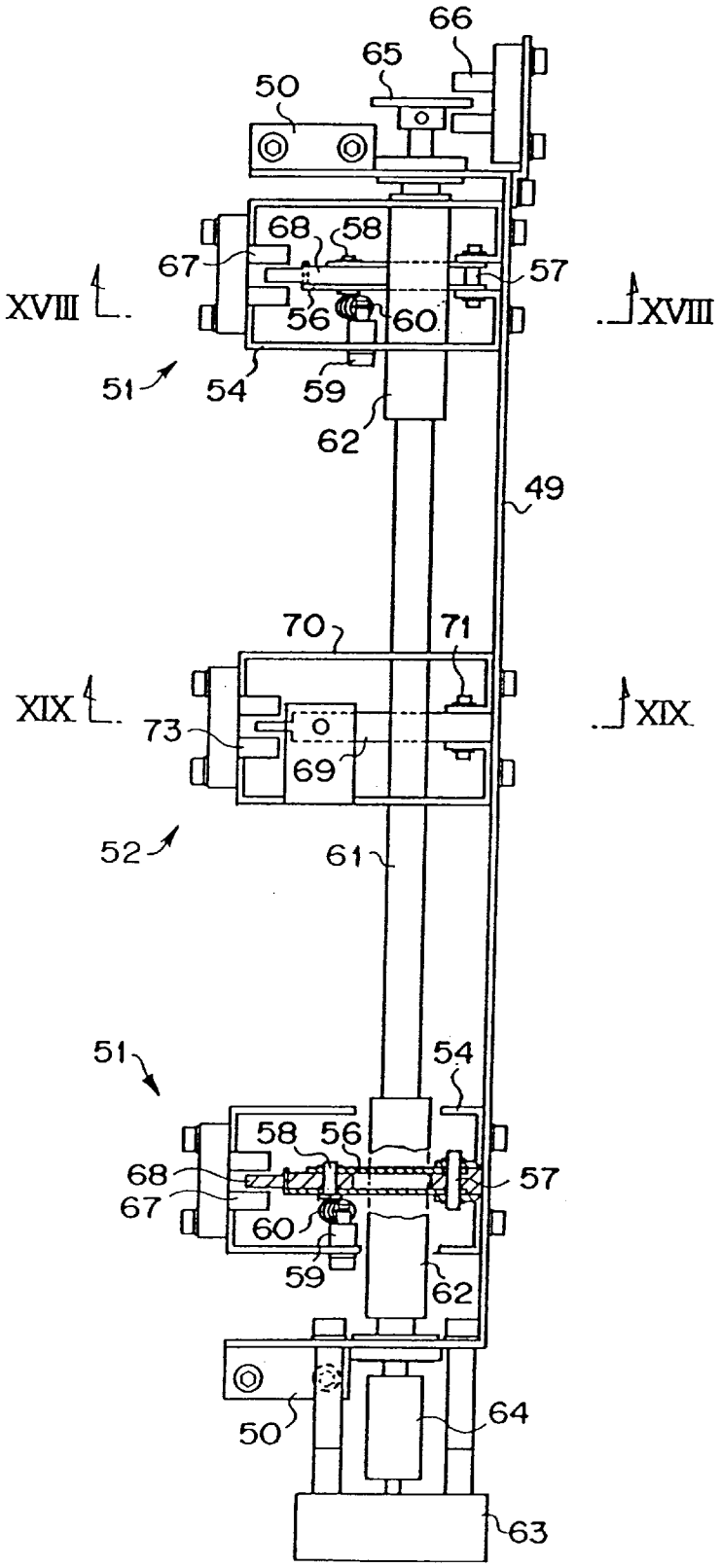
FIG. 17 is an extracted enlarged plan view of a portion of a sensor bracket of FIG. 15.

As shown in FIG. 15, in which the general construction of this embodiment is shown and in FIG. 16 where a sectional side elevation is shown, at the center portion of a base plate 13 having a plurality of pedestals 12 mounted on a mounting surface, such as a floor, table and so forth, a pair of left and right side frames 14 extending in back-and-forth direction (left and right direction in the drawing) in parallel relationship to each other, are extended upwardly in vertical direction. On front and rear sides of upper portions of the side frames 14, both of left and right side ends of a pair of front and rear pulley shafts 15F and 15R which are parallel to the surface of the base plate 13 are rotatably mounted. On belt pulleys 16 respectively formed on a pair of front and rear pulley shafts 15F and 15R, left and right two endless transporting belts 17 are wound around. On the side frame 14 supporting one end side of one pulley shaft 15F, a stepping motor 18 (hereinafter occasionally referred to as pulley driving motor) for driving the pulley shafts 15F and 15R is mounted. Also, a reduction gear 21 for transmitting the rotational force of a pulley shaft driving gear 19 integral with the pulley shaft driving motor 18 to a pulley shaft driven gear 20 provided at one end side of the pulley shaft 15F, are provided rotatably.

Accordingly, by driving the pulley shaft driving motor 18, one pulley shaft 15F is driven to rotate. Associating with this, the left and right endless transporting belts 17 are driven to circulate in the clockwise direction in FIG. 16, to transport a printing object 22 mounted at one end side (right side in the drawing) of the transporting belts 17 toward the other end side. The above-mentioned pulley shaft driving motor 18, the pulley shaft driven gear 20 and the reduction gear 21 form a belt driving means of the present invention.

It should be noted that between the other pulley shaft 15R and the side frames 14 supporting the other pulley shaft 15R a tension adjusting mechanism (not shown) which can move the other pulley 15R relative to the side frame 14 in the back-and-forth direction of the base plate 13, is assembled in order to make it possible to adjust the tension of the transporting belts 17.

On left and right ends of the center portion of the base plate 13, camshaft brackets 24, 25 respectively supporting a pair of front and rear camshafts 23F and 23R in rotatable fashion, are secured. On the pair of front and rear camshafts 23F and 23R rotatably supported on these camshaft brackets 24, 25 so that they may extend through window portion 26 formed at the center portion of the side frames 14 in opposition to the surface of the base plate 13, being parallel to each other and to the surface of the base plate 13, eccentric cams 27 are formed integrally. On a synchronization gear 28 provided in order to constantly match the rotational phases of these eccentric cams 27 relative to the pair of front and rear camshafts 23F and 23R, an endless cogged belt 29 is wound around. Thus, the height from the surface of the base plate 13 to the upper end surface of respective eccentric cams 27 can be set at a constant.

On one end side of one camshaft 23R rotatably supported on one camshaft bracket 24 provided at one end side of the base plate 13 in a condition extending through the latter, a camshaft follower gear 30 and a rotary disc 31 are provided in coaxial and integral fashion. Also, on the cam shaft bracket 24, a reversible stepping motor 32 (hereinafter occasionally referred to as camshaft driving motor) for driving the camshafts 23F and 23R is mounted. Also, a reduction gear train 34 for transmitting the rotational force of a camshaft driving gear 33 integral with the camshaft driving motor 32 to the camshaft follower gear 30 is provided in rotatable fashion. On the outer circumference of the rotary disc 31, a not-shown cut-out is formed at one position. A reference position detecting sensor 35 for detecting the cut-out is mounted on the base plate 13. When the reference position detecting sensor 35 detects the cut-out of the rotary disc 31, the distances from the camshafts 23F and 23R to the upper end surface of the eccentric cams 27 become minimum, as shown in FIG. 16.

Namely, the reference positions of the camshafts 23F and 23R are the rotational phases of the camshafts 23F and 23R where the distance to the upper end surface of the eccentric cams 27 become minimum. From this condition, the camshaft driving gear 33 of the camshaft driving motor 32 is driven in the forward direction to lift up a latter-mentioned lifting table 36 relative to the base plate 13. Then, by the camshaft driving motor 32, the reduction gear train 34, the camshaft follower gear 30, the camshafts 23F and 23R and the eccentric cams 27, the shifting means of the present invention is constructed.

Between one camshaft 23F and the camshaft bracket 24 supporting one camshaft 23F, a not shown tension adjusting mechanism which can move one camshaft 23F in back-and-forth direction of the base plate 13 relative to the cam shaft bracket 24 is assembled.

On both of the left and right sides of the lifting table 36 mounted on the eccentric cams 27 for sliding contact with the eccentric cams 27 and extending through the window portion 26 across the side frames 14, a lifting guide bar 38 extending through and slidably engaging lifting guide cylinders 37 provided on the base plate 13, is extended vertically in downward direction. Also, between the lifting table 36 and the base plate 13, a not shown tension spring for biasing the lifting table 36 toward the base plate 13 so that the lifting table 36 is constantly held in contact with the eccentric cams 27, is disposed. By synchronously driving the pair of front and rear camshafts 23F and 23R associated with driving of the camshaft driving motor 32, the lifting table 36 is lifted up and down in FIG. 16, along the lifting guide bar 38 on the base plate 13.

On both of left and right side ends of a top beam 39 extending over the center portion of the side frames 14 in the left and right direction, the upper end of a column 41 having the lower end detachably secured to the lifting table 36 at the portion projecting to the side of the side frame 14 by means of screw via a height adjusting block 40, is integrally connected. In the shown embodiment, in order to maintain a clearance between a printing surface 42 of the printing object 22 and the later mentioned ink-jet head 43 constant, the eccentricity of the eccentric cams 27 is adjusted by driving the camshafts 23F and 23R to rotate. However, when a printing operation is to be performed for the printing object 22 which differentiates the thickness beyond the range of adjustment which can be adjusted only by the eccentricity of the camshafts 23F and 23R, the height adjusting block 40 can be replaced with one having appropriate height. Therefore, so that the column 41 can be positioned at an accurate position relative to the lifting table 36, constantly, a positioning pin 44 is disposed between the base plate 13 and the column 41.

On the upper end portion of the pair of left and right columns 41, respective ends of a unit guide bar 45 and a primary scan threaded shaft 46 are mounted. Both end portions of the primary scan threaded shaft 46 are rotatably supported with respect to the column 41. One end of the primary scan threaded shaft 46 is connected to a reversible stepping motor 47 (hereinafter occasionally referred to as primary scan threaded shaft driving motor). An ink-jet unit 48, with which the primary scan threaded shaft 46 is threadingly engaged and through which the unit guide bar 45 extends in slidable fashion, is reciprocally shifted in left and right direction above the transporting belts 17 along the unit guide bar 45 associating with driving of the primary scan threaded shaft 46. Namely, the top beam 39, the column 41, the unit guide bar 45 and the primary scan threaded shaft 46 form an ink-jet unit mounting portion of the present invention.

It should be noted that the ink-jet unit 48 is constructed by mounting the ink-jet head 43, in which a plurality of not shown ink ejection openings opening downwardly at the lower end of the ink-jet unit, are arranged in the back-and forth direction (left and right direction in the drawing). Such construction of the ink-jet unit has been know as disclosed in Japanese Patent Application Laid-open No. 99006/1994. In this case, it is possible to replaceably mount a not shown ink-tank supplying ink to the ink-jet head 43 on the ink-jet unit 48. When the ink tank is mounted on the ink-jet unit 48, the ink-jet head 43 may be formed separably, or in the alternative integrally.

Figure 18:
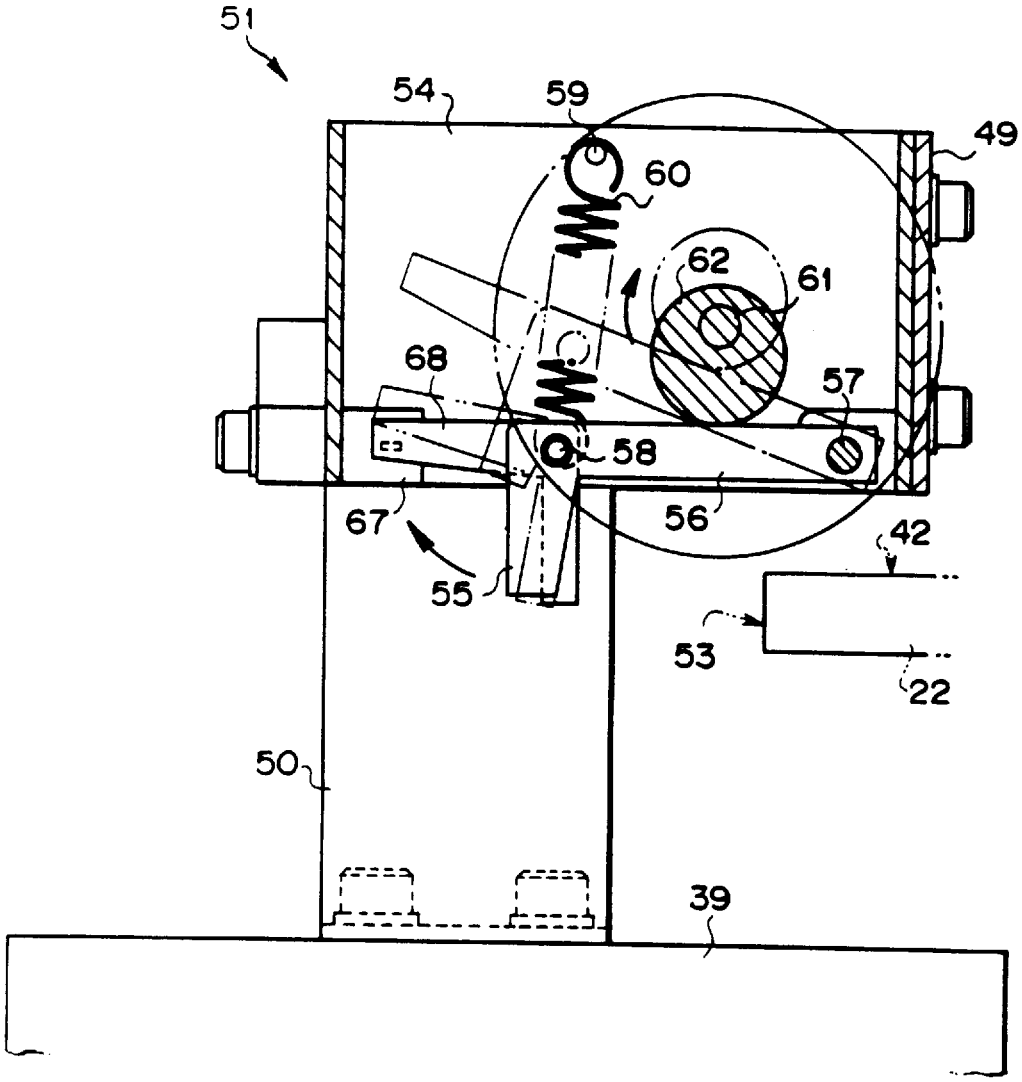
FIG. 18 is a section taken along line XVIII—XVIII of FIG. 17.
Figure 19:
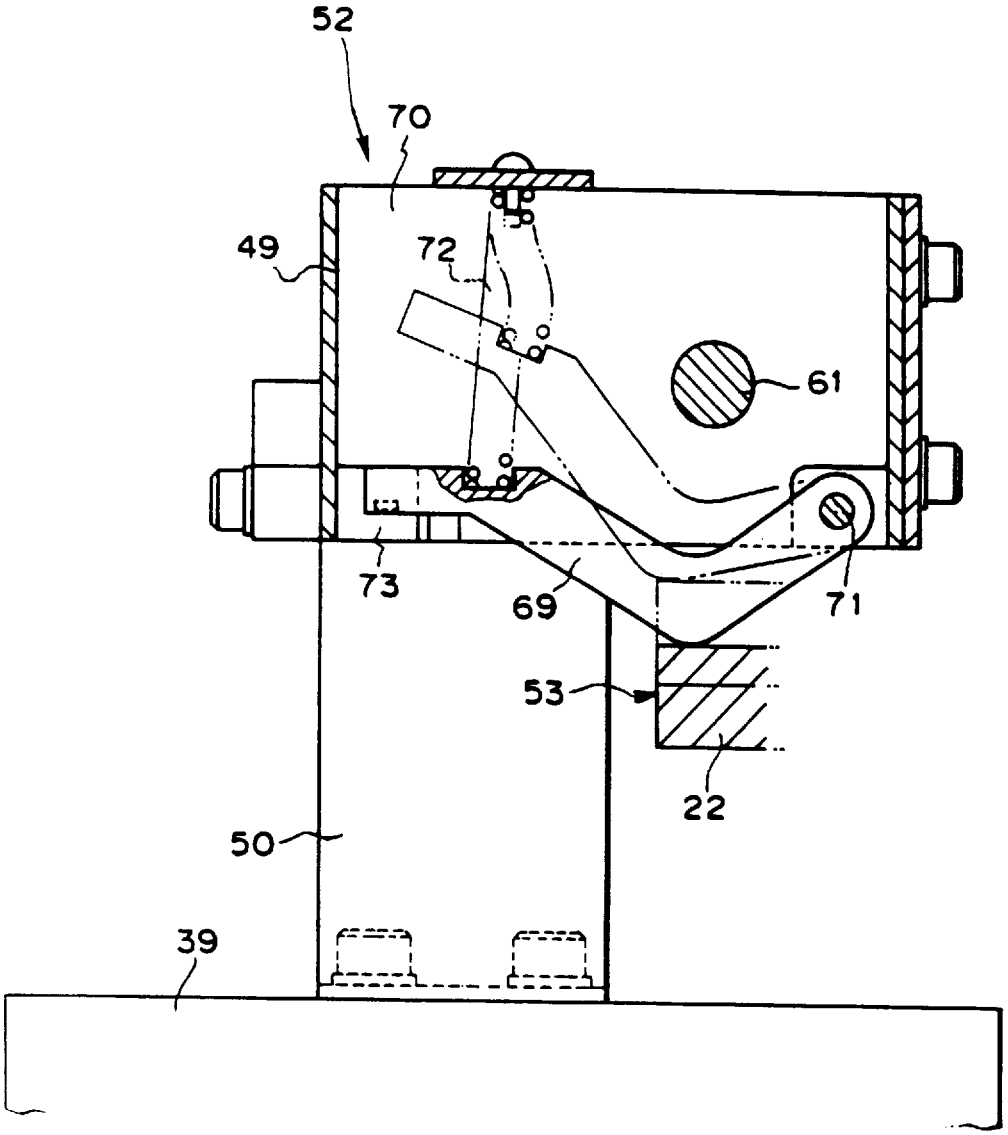
FIG. 19 is a section taken along line XIX—XIX of FIG. 17.

To both of left and right end portions of the top beam 39, bracket mounting portions 50 formed at both of the left and right side end portions of sensor bracket 49 extending along the top beam 39 are screwed. A portion of the sensor bracket 49 is extracted and enlarged in FIG. 17. Also, the section taken along line XVIII—XVIII is shown in FIG. 18, and the section taken along line XIX—XIX is shown in FIG. 19. As shown in these figures, on the sensor bracket 49, two positioning stoppers 51 and a clearance adjusting sensor 52 are mounted. The clearance adjusting sensor 52 is disposed between two positioning stoppers 51.

The positioning stoppers 51 are adapted to set the leading end 53 of the printing object 22 relative to the ink-jet unit 48 at the predetermined position. So that it may be adapted to a printing object 22 having a large width dimension, two positioning stoppers 51 of identical construction are arranged at both of the left and right sides in the width direction of the transporting belts 17. Then, the base end portion of a stopper lever 56 in the form of a bell crank and formed with a stopper portion 55 having the tip end projecting downwardly, is pivotally secured on the casings 54 of the positioning stoppers 51 via pivot pins 57. On a connecting pin 58 projected at the intermediate portion of the stopper lever 56 and a spring receptacle pin 59 provided in the casing 54, both end portions of a tension spring 60 are engaged for upwardly (in FIG. 18) biasing the other end of the stopper lever 56.

On a lever holding shaft 62 having both ends extending through the positioning stopper 51 and the clearance adjusting sensor 52 and supported at both of the left and right end portions of the sensor bracket 49, an eccentric cam 62 which can hold the stopper lever 56 at the projecting position shown by solid line in FIG. 18 against the spring force of the tension spring 60 and holding at retracted position shown by two-dotted line, is formed integrally. The eccentric cam 62 is held in contact with the base end portion of the stopper lever 56. On the other hand, at one end side of the lever holding shaft 61, a stepping motor 63 (hereinafter occasionally referred to as stopper switching drive motor) for driving the lever holding shaft 61 mounted on the sensor bracket 49 to rotate, is connected via a joint 64. On the other end side of the lever holding shaft 61, a rotary disc 65 for detecting a projecting position of the stopper lever 56 is provided in coaxially integrated fashion. On the outer periphery of the rotary disc 65, a not shown cut-out is formed at one portion. A projected position detecting sensor 66 for detecting the cut-out is mounted at the other end of the sensor bracket 49. When the projected position detecting sensor 66 detects the cut-out of the rotary disc 65, the stopper lever 56 is set at the projected position as shown by the solid line in FIG. 18.

On the connecting pin 58 of the stopper lever 56, a detection lever 68 in the form of a bell crank is pivotally secured in a condition projecting downwardly at one end side and covering a stopper switch 67 at the other end side. The detection lever 68 is maintained at the position shown by the solid line in FIG. 18 by means of a not shown spring mechanism. Then, at this projecting position, the printing object 22 is fed in from the right side in FIG. 18 and the leading end 53 thereof comes in contact with the detection lever 68, and further in contact with the stopper portion 55 of the stopper lever 56 to stop. At this time, as shown by two-dotted line, the detection lever 68 is pivoted in counterclockwise about the connecting pin 58 to turn the stopper switch 67 ON. The stopper switching drive motor 63 is actuated in response to ON signal of the stopper switch 67 to rotate the lever holding shaft 61 over 180°. Therefore, the stopper lever 56 is pulled up to the retracted position shown by two-dotted line in FIG. 18 by the spring force of the tension spring 60. Thus, the printing object 22 is permitted to pass immediately below the positioning stoppers 51. The lever holding shaft 61, the eccentric cam 62 and the stopper switching drive motor 63 and so forth form a stopper driving means of the present invention.

The clearance adjusting sensor 52 is mounted at the center portion of the sensor bracket 49, together with a swing lever 69 in a form of bell crank, a pivot pin 71 pivotally securing the base end portion of the swing lever 69 to a casing 70, a flexible member 72 provided between the leading end portion of the swing lever 69 and the casing 70 and formed with a coil spring for holding the center portion of the swing lever 69 at the position illustrated by the solid line in FIG. 19, and a sensor switch 73, such as a penetration type photoelectric switch. Then, the upper end of the swing lever 69 of the condition overlapping with the sensor switch 73 is pivoted clockwise over a predetermined magnitude or greater against the holding force of the flexible member 72. At a timing shifted away from the sensor switch 73 in the predetermined magnitude, the signal output from the sensor switch 73 is turned ON.

Since the lower end of the swing lever 69 is mechanically contacted with the printing surface 42 of the printing object, the clearance between the printing surface 42 of the printing object 22 and the ink-jet head 43 can be accurately adjusted constantly. Also, in the shown embodiment, at the timing where the clearance adjusting sensor 52 is turned ON, driving of the camshaft driving motor 32 in the forward direction is terminated, and then the camshaft driving motor 32 is driven in the reverse direction for a predetermined magnitude. Upon reaching the predetermined magnitude of reverse driving of the camshaft driving motor 32, the clearance between the printing surface 42 of the printing object 22 and the ink-jet head can be set appropriate. At this time, the clearance adjusting sensor 52 contacts on the printing surface 42 of the printing object 22 only temporarily.

On the other hand, at the side of one transporting belt 17 positioned at the feed-in side of the printing object 22 relative to the ink-jet unit 48, an offsetting device 75 as a printing object offsetting means of the present invention, is provided for pushing the side edge surface at one side toward the side plate 14.

Figure 20:
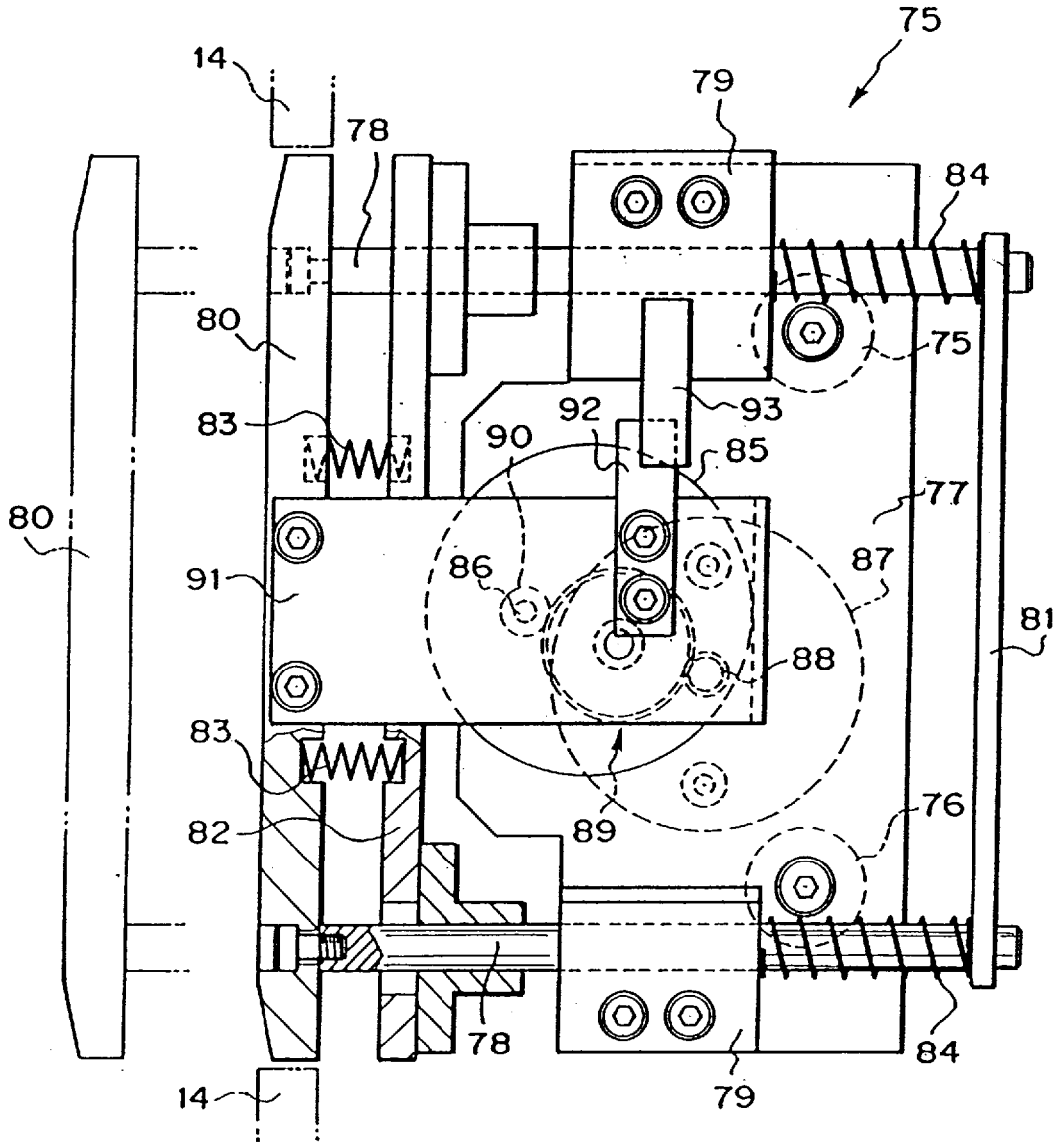
FIG. 20 is an extracted enlarged plan view of a portion of an inclining device in the embodiment of the ink-jet printing apparatus of FIG. 15.
Figure 21:
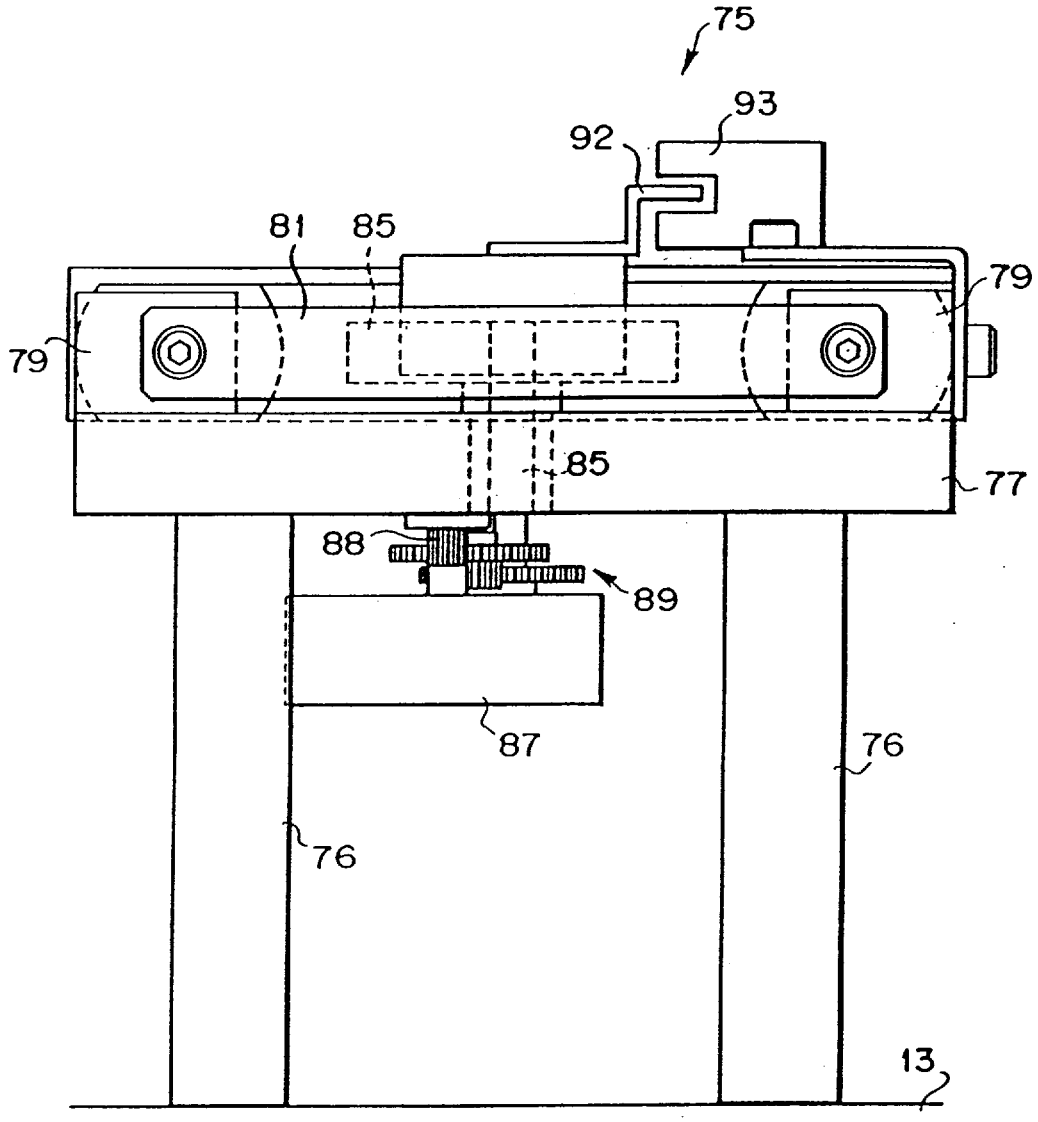
FIG. 21 is a right side elevation of the inclining device of FIG. 20.
Figure 22:
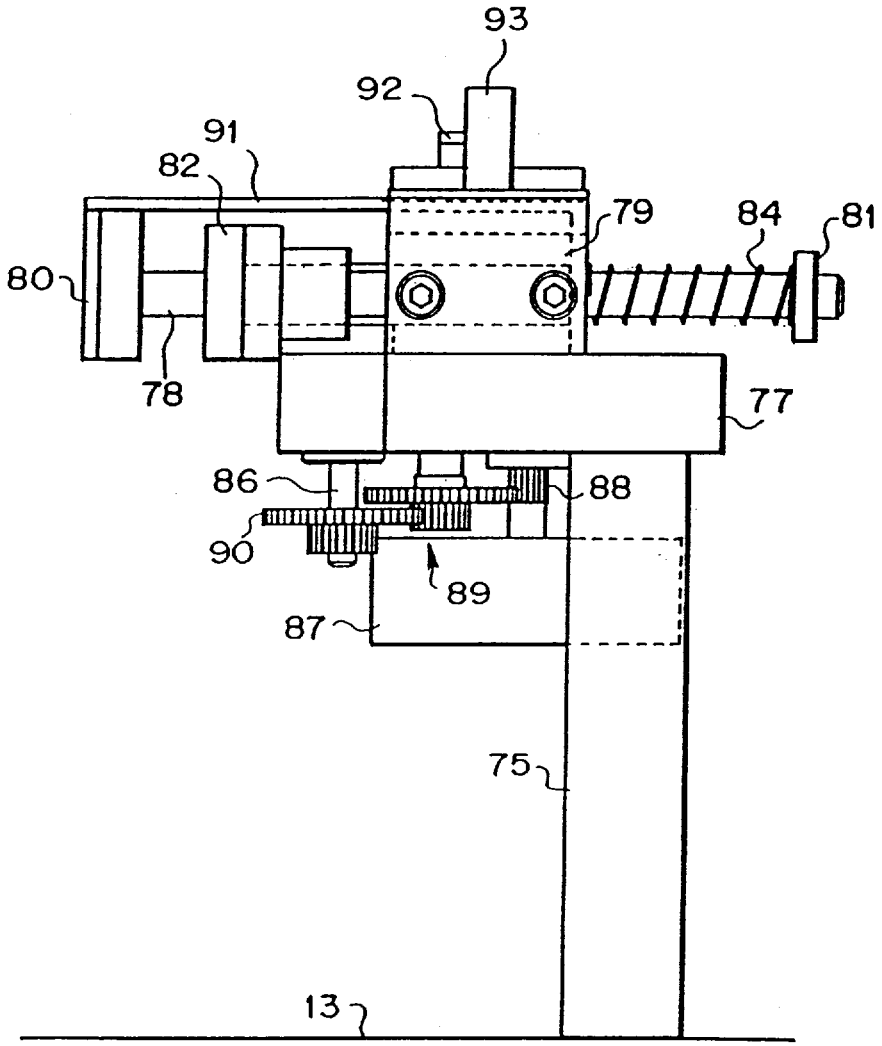
FIG. 22 is a front elevation of the inclining device of FIG. 20.

The portion of the offsetting device 75 is extracted and illustrated in FIG. 20 in enlarged manner. FIG. 21 shows a right side elevation of the portion of the offsetting device shown in FIG. 20, and FIG. 21 shows front elevational configuration thereof. At the front and rear sides of a platform 77 fixed on the base plate 13 via two supporting frames 76, supporting blocks 79 slidably supporting the pair of guide bars 78 are fixed. The fixing position of the support 76 relative to the base plate 13 is adjustable in the vertical direction depending upon the dimension of the printing object 22. Both of the front and rear end portions of a pair of guide bars 78 slidably extending through the supporting blocks 79, are secured in parallel relationship by the offsetting plate 80 and the supporting block 79. Between the offsetting plate 80 and the supporting block 79, is a buffering plate 82 through which bar guide 78 is slidably extending. On the other hand, for the guide bar 78 positioned between the connecting plate 81 and the support block 79, a return spring 84 for biasing the offsetting block 80 toward the supporting block 79, is disposed. The spring force of the return spring 84 is smaller than the spring force of the foregoing buffering screw.

At the center portion of the platform 77, a camshaft 86 formed with an eccentric cam 85 which slidably contacts a buffering plate 82 by the spring force of the return spring 84. On the camshaft 86, a camshaft driven gear 90 meshing with a camshaft driving gear 88 of the offsetting drive motor 87 via a reduction gear train 89. Namely, when the camshaft driving gear 88 of the offsetting drive motor 87 is driven to rotate, the camshaft driven gear 90 is driven to rotate together with the eccentric cam 85 via the reduction gear train 89 rotatably provided at the back side of the platform 77. Then, depending upon the eccentricity of the eccentric cam 85, the buffering plate 82 is advanced up to the position illustrated by the two-dotted line in FIG. 20 against the spring force of the return spring. At this timing, the side edge surface 74 of the printing object 22 on the transporting belts 17 is abutted against the side frame 14 at the opposite side. Namely, the offsetting plate 80 and the side frame 14 (lower side in FIG. 15) are opposing to form a side surface reference plate.

In the shown embodiment, the offsetting plate 80 is not directly driven by the eccentric cam 85 and is driven via the buffering plate 82. Therefore, by the spring force of the buffering spring 83, a mechanical play is formed between the buffering plate 82 and the offsetting plate 80 so that the buffering plate 82 can be relatively movable against the spring force of the buffering spring 83 with respect to the guide bars 78 even when the offsetting plate 82 cannot be advanced for some reason.

On the other hand, in order to verify the retracted position of the offsetting plate 80 as shown by the solid line in FIG. 20, one end of a plate 91 extending in toward the connecting plate 81 is fixed at the center portion of the offsetting plate 80. A detecting arm 92 fixed to the other end of the plate 91 in such a manner that the detecting arm 92 overlaps with a retracted position detecting sensor 93 mounted on one of the supporting blocks 79. Namely, as shown in FIG. 20, at a timing where the detecting arm 92 overlaps with the retracted position detecting sensor 93, the retracted position detecting sensor 93 is turned ON. In response to an ON state output of the retracted position detecting sensor 93, operation of the offsetting drive motor 87 is terminated to maintain the offsetting plate 80 at the retracted position.

It should be noted that, in the shown embodiment, between the transporting belts 17 at left and right sides in the lateral direction relative to the offsetting device 75, a suction duct 94 for temporarily sucking and fixing the printing object 22 is provided. To the suction duct 94, a not shown cooling fan for cooling not shown electronic circuits and so forth is connected via a not shown electromagnetic switching dumper. When the stopper lever 56 is retracted in the retracted position, the back side of the printing object is drawn down by suction so that the printing object may not be displaced by a friction between the stopper portion 55 and the tip end of the printing object 22. The electromagnetic switching dumper is controlled so that a sucking operation will not performed at the timing other than that claimed above.

Accordingly, with mounting the printing object 22 on the transporting belts 17, the pulley shaft driving motor 18 is driven to abut the leading end 53 of the printing object 22 to the stopper portion 55 of the stopper lever 56 in the projected position. In this manner, the detecting lever 68 is pivoted to turn ON the stopper switch 67 to actuate the offsetting drive motor 87 until the detecting arm 92 interrupts the retracted position detecting sensor 93 again, namely until the camshaft 86 rotates over one turn from the stand-by condition shown in FIG. 20. In this manner, the offsetting plate 80 is reciprocally shifted in one cycle to push the side edge surface 74 of the printing object 22 to the corresponding side frame 14. Thus, positioning of the printing object 22 on the transporting belts 17 is completed. During this period, the pulley shaft driving motor 18 continues operation. At the timing where the retracted position detecting sensor 93 is turned ON by the detecting arm 92, the electromagnetic switching dumper is switched to initiate a sucking or drawing operation of the printing object 22 by the suction duct 94. In conjunction therewith, the pulley shaft driving motor 18 is temporarily stopped.

Next, the stopper switching drive motor 63 is turned over 180° to shift the stopper lever 56 to the retracted position. Furthermore, the camshaft driving motor 32 is actuated. Then, the clearance between the printing surface 42 of the printing object 22 and the ink-jet head 43 is set at the predetermined value by the clearance adjusting sensor 52. Thereafter, the electromagnetic switching dumper is switched to terminate the sucking operation of the printing object 22 by the suction duct 94. In conjunction therewith, the pulley shaft driving motor 18 is driven again, and the primary scan threaded shaft driving motor 47 and the ink-jet unit 48 are actuated to perform a printing operation.

It should be noted that when the thickness of the printing object 22 is gradually increased along the scanning direction on the transporting belts 17 driven by the pulley shaft driving motor 18, it is possible that the clearance adjusting sensor 52 is turned ON during printing operation. In such case, it may be impossible to maintain good quality of printing. Therefore, in the shown embodiment, when the clearance adjusting sensor 52 is turned ON during printing operation, driving of the pulley driving motor 18 is terminated to interrupt the printing operation in order to prevent the clearance adjusting sensor 52 from being damaged.

It should be noted that in the case of the above-mentioned embodiment, while the ink-jet unit 48 is scanned in the width direction of the printing object 22, it is possible to employ a so-called full-line type ink-jet head, in which the ink ejection openings are arranged over the entire width of the top beam 39 or the connecting beam 76. In the case of where a full-line type ink-jet head is employed, the mechanism for scanning the ink-jet head in the width direction of the printing object 133 becomes unnecessary. Also, in the embodiment claimed above, while the lifting table 36 is lifted up and down by means of the eccentric cams 27, it is naturally possible to employ other known lifting mechanisms.

Figure 23:
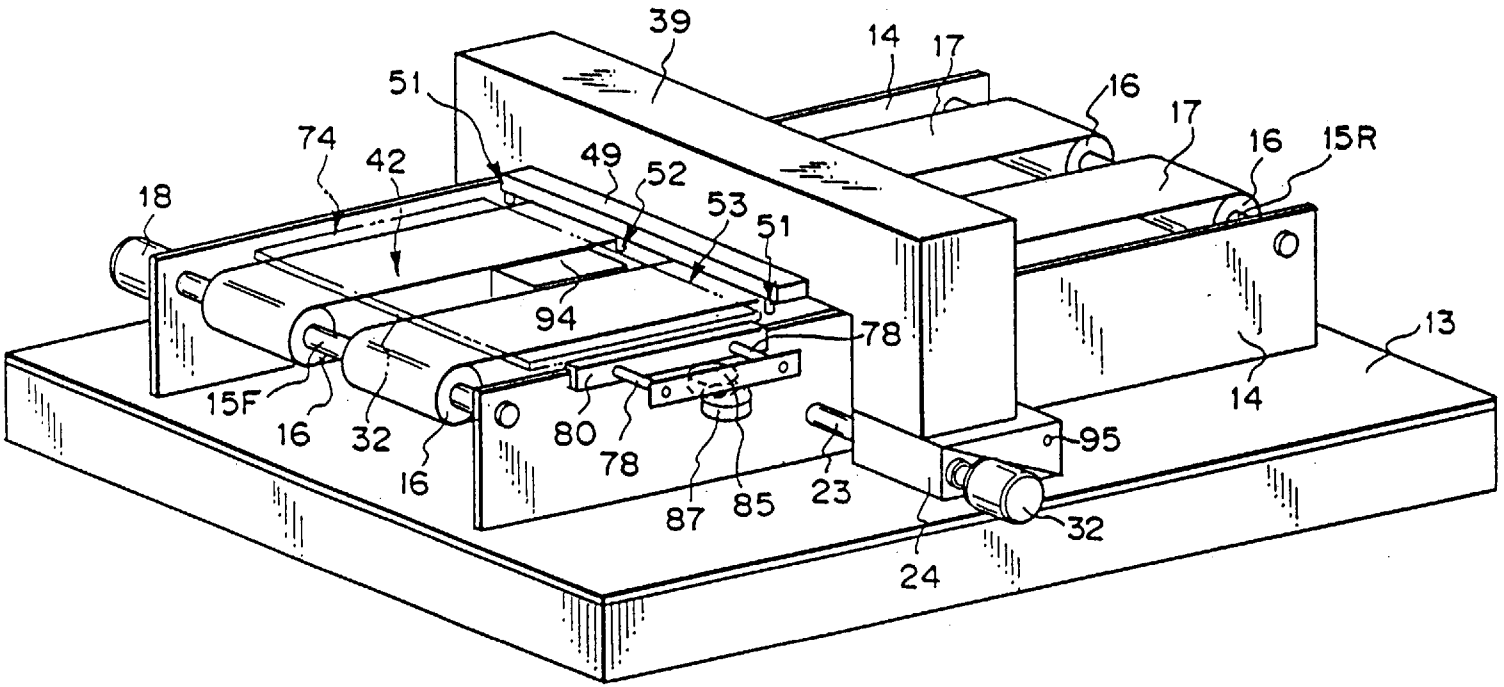
FIG. 23 is a perspective view showing general construction of a still further embodiment of the ink-jet printing apparatus according to the invention.

General construction of such another embodiment of the present invention is illustrated in FIG. 23. It should be noted that, in the following discussion, like elements achieving essentially the same functions are identified by the same reference numerals and the detailed description therefor is omitted. Namely, one end side in the back-and-forth direction at the lower end portions of the left and right columns 41 are rockably supported on the base plate 13 via a rocking pin 95 which is parallel to the pulley shafts 15F and 15R. On the other hand, the other end sides in the back-and-forth direction of the columns 41 are in contact with not shown eccentric cams mounted on the camshaft 23 mounted on the base plate 13 in parallel relationship with the pulley shafts 15F and 15R. The upper end surfaces of the eccentric cams are pushed against the lower ends of the columns 41 by means of not shown biasing means.

Then, by driving the camshaft driving motor 32 connected to the camshafts 23, the other ends of the columns 41 rock in vertical direction about the rocking pin 95, the clearance between the printing surface 42 of the printing object 22 and the not shown ink-jet head can be varied. In this case, by setting the distance between the rocking pin 95 and the camshafts 23 greater, harmful influence due to inclination of the ink-jet head relative to the printing surface 42 of the printing object 22 can be substantially ignored. Also, in comparison with the former embodiment, a simpler apparatus can be realized since the lifting table and so forth become unnecessary.

The present invention achieves distinct effect when applied to an ink-jet printing head or an ink-jet printing apparatus which has means for generating thermal energy such as electrothermal transducers, and which causes changes in ink by thermal energy so as to eject ink.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink-jet printing systems, it is particularly suitable for the on-demand type apparatus. This is because the on-demand type apparatus has electrothermal transducers, each disposed on a sheet or ink passage that retains ink, and operates as follows: first, one or more drive signals are applied to the electrothermal transducers to cause thermal energy corresponding to printing information; second, the thermal energy induces sudden temperature rise that exceeds the nucleate boiling temperature so as to cause film boiling on heating portions of the ink-jet printing head; and third, bubbles are grown in the ink corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

The present invention also can be applied to a so-called full-line type ink-jet printing head whose length equals the maximum length across a printing medium. Such an ink-jet printing head may consists of a plurality of printing heads combined together, or one integrally arranged printing head.

In addition, the present invention can be applied to various serial type ink-jet printing heads: an ink-jet printing head fixed to the main assembly of an ink-jet printing apparatus; a conveniently replaceable chip type printing head which, when loaded on the main assembly of an ink-jet printing apparatus, is electrically connected to the main assembly, and is supplied with ink therefrom; and a cartridge type printing head integrally including an ink reservoir.

It is further preferable to add a recovery system, or a preliminary auxiliary system for an ink-jet printing head as a constituent of the ink-jet printing apparatus because they serve to make the effect of the present invention more reliable. Examples of the recovery system, are a capping means and a cleaning means for the printing head, and a pressure or suction means for the printing head. Examples of the preliminary auxiliary system, are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used.

What is claimed is:

1. An ink-jet printing method for performing printing of predetermined information on a printing surface of a printing object employing a printing apparatus comprising:

a printing object mounting portion, on which said printing object is mounted, an ink-jet unit mounting portion, on which an ink-jet head opposing said printing object is mounted, shifting means for shifting said ink-jet unit mounting portion relative to said printing object mounting portion in an opposing direction, a clearance adjusting sensor provided at said ink-jet unit mounting portion and arranged so as to be capable of contacting said printing surface of said printing object, said clearance adjusting sensor sensing whether or not said sensor is in contact with said printing surface of said printing object, said method comprising the steps of:

driving said shifting means in a direction where said clearance adjusting sensor is caused to contact said printing surface of said printing object, and thus contacting said clearance adjusting sensor to said printing--surface of said printing object;

driving said shifting means in an opposite direction after said clearance adjusting sensor comes into contact with said printing surface of said printing object, shifting said ink-jet unit mounting portion relative to said printing object mounting portion in a direction where said clearance adjusting sensor moves away from said printing surface of said printing object by a predetermined magnitudes; and printing on said printing surface of said printing object with said ink-jet head.

2. An ink-jet printing method as claimed in claim 1, wherein said shifting means shifts said printing object mounting portion relative to said ink-let unit mounting portion in parallel in the opposing direction.

3. An ink-jet printing method as claimed in claim 1, wherein said shifting means tilts the printing object mounting portion in a width direction thereof.

4. An ink-jet printing method as claimed in claim 1, wherein said clearance adjusting sensor includes a lever, one end of said lever projecting toward said printing surface of said printing object, biasing means for biasing the one end of said lever toward said printing surface of said printing object, and a switch that detects displacement of the other end of said lever beyond a predetermined magnitude against said biasing means.

5. An ink-jet printing method as claimed in claim 1, wherein said clearance adjusting sensor is shiftable along a width direction of said printing object mounting portion.

6. An ink-jet printing method as claimed in claim 1, comprising two clearance adjusting sensors each provided so as to be capable of shifting along a width direction of said printing object mounting portion.

7. An ink-jet printing method as claimed in claim 1, further comprising a step of driving said shifting means for setting a predetermined clearance between said ink-jet unit mounting portion and said printing object mounting portion, and whereby said shifting means is driven in a direction where said clearance adjusting sensor is caused to contact said printing surface of said printing object from a state where the clearance between said ink-jet unit mounting portion and said printing object mounting portion is set at the predetermined value.

8. An ink-jet printing apparatus comprising:

a printing object mounting portion, on which said printing object is mounted;

an ink-jet unit mounting portion arranged to be shifted relative to said printing object mounting portion, and mounting an ink-jet head for opposing said printing surface of said printing object;

shifting means for shifting said ink-jet unit mounting portion relative to said printing object mounting portioning an opposing direction;

a clearance adjusting sensor provided at said ink-jet unit mounting portion and arranged so as to be capable of contacting said printing surface of said printing object, said clearance adjusting sensor sensing whether or not said sensor is in contact with said printing surface of said printing object;

control means for driving said shifting means in a direction where said clearance adjusting sensor is caused to contact said printing surface of said printing object, driving said shifting means in an opposite direction when said clearance adjusting sensor comes into contact with said printing surface of said printing object, and shifting said ink-jet unit mounting portion relative to said printing object mounting portion in a direction where said clearance adjusting sensor moves away from said printing surface of said printing object by a predetermined magnitude; and printing control means for controlling printing on said printing surface object by said ink-jet head after a clearance between said ink-jet head and said printing object is adjusted by said control means.

9. An ink-jet printing apparatus as claimed in claim 8, wherein said shifting means shifts said printing object mounting portion relative to said ink-let mounting portion in parallel in the opposing direction.

10. An ink-jet printing apparatus as claimed in claim 8, wherein said shifting means tilts said printing object mounting portion along a width direction thereof.

11. An ink-jet printing apparatus as claimed in claim 8, wherein said clearance adjusting sensor includes a lever, one end of said lever projecting toward said printing surface of said printing object, biasing means for biasing the one end of said lever toward said printing surface of said printing object, and a switch that detects displacement of the other end of said lever beyond a predetermined magnitude against said biasing means.

12. An ink-jet printing apparatus as claimed in claim 8, wherein said clearance adjusting sensor is shiftable along a width direction of said printing object mounting portion.

13. An ink-jet printing apparatus as claimed in claim 8, comprising two clearance adjusting sensors each arranged so as to be capable of shifting along a width direction of said printing object mounting portion.

14. An ink-jet printing apparatus as claimed in claim 8, which further comprises initial setting means for driving said shifting means for setting a predetermined clearance between said ink-jet unit mounting portion and said printing object mounting portion, and said control unit drives said shifting means in a direction where said clearance adjusting sensor is caused to contact said printing surface of said printing object from a state where the clearance between said ink-jet unit mounting portion and said printing object mounting portion is set at the predetermined value by said initial setting means.

15. An ink-jet printing apparatus as claimed in claim 14, wherein said initial setting means is a reference position detecting sensor that holds a mechanical position of said shifting means at a predetermined position.

16. An ink-jet printing apparatus as claimed in claim 8, wherein said ink-jet head generates bubbles utilizing thermal energy and thereby ejects ink.

17. An ink-jet printing apparatus for printing on a printing object, said apparatus comprising:

a transporting belt on which a printing object is mountable for scanning the printing object;

belt driving means for driving said transporting belt;

a side surface reference plate provided at one end side in the width direction of said transporting belt, and against which a side edge portion of said printing object is contactable;

printing object offsetting means for pushing the side edge portion of said printing object on said transporting belt toward said side surface reference plate;

an ink-jet unit mounting portion arranged so as to be capable of relative movement in a perpendicular direction with respect to the surface of said transporting belt, and for mounting thereon an ink-jet head opposing said printing surface of said printing object;

a positioning stopper arranged at a side of said ink-jet unit mounting portion so as to be capable of contacting a leading end of said printing object;

stopper driving means for selectively driving said positioning stopper between a projecting position contactable with the leading end of said printing object and a retracted position not contactable with said printing object;

shifting means for shifting said ink-jet unit mounting portion relative to said transporting belt in an opposing direction;

a clearance adjusting sensor arranged on the side of said ink-jet unit mounting portion so as to be capable of contacting said printing surface of said printing object, said clearance adjusting sensor sensing whether or not said sensor is in contact with said printing surface of said printing object; and control means for driving said shifting means in a direction where said clearance adjusting sensor is caused to contact said printing surface of said printing object, driving said shifting means in an opposite direction when said clearance adjusting sensor comes into contact with said printing surface of said printing object, and shifting said ink-jet unit mounting portion relative to said transporting belt in a direction where said clearance adjusting sensor moves away from said printing surface of said printing object by a predetermined magnitude.

18. An ink-jet printing apparatus as claimed in claim 17, wherein said shifting means shifts said transporting belt relative to said ink-jet mounting portion in parallel in the opposing direction.

19. An ink-jet printing apparatus as claimed in claim 17, wherein said clearance adjusting sensor includes a lever, one end of said lever projecting toward said printing surface of said printing object, biasing means for biasing the one end of said lever toward said printing surface of said printing object, and a switch that detects displacement of the other end of said lever beyond a predetermined magnitude against said biasing means.

20. An ink-jet printing apparatus as claimed in claim 17, which further comprises initial setting means for driving said shifting means for setting a predetermined clearance between said ink-jet unit mounting portion and said transporting belt, and said control means drives said shifting means in a direction where said clearance adjusting sensor is caused to contact said printing surface of said printing object from a state where the clearance between said ink-jet unit mounting portion and said transporting belt is set at the predetermined value by said initial setting means.

21. An ink-jet printing apparatus as claimed in claim 20, wherein said initial setting means is a reference position detecting sensor that holds a mechanical position of said shifting means at a predetermined position.

22. An ink-jet printing apparatus as claimed in claim 17, wherein said ink-jet head generates bubbles utilizing thermal energy and thereby ejects ink.

23. An ink-jet printing method as claimed in claim 1, further comprising the step of shifting said printing object mounting portion relative to said ink-jet unit mounting portion in a direction parallel to the printing surface of said printing object in a state where the clearance adjusting sensor is shifted away from the printing surface of said printing object by a predetermined magnitude so as to perform printing of said predetermined information on said printing surface of said printing object.

24. An ink-jet printing apparatus as claimed in claim 8, further comprising:

scanning means for shifting said printing object mounting portion relative to said printing object mounting portion in a direction parallel to said printing surface of said printing object.

25. An ink-jet printing method for performing printing of predetermined information on a printing surface of a printing object employing a printing apparatus comprising:

a printing object mounting portion, on which said printing object is mounted, an ink-jet unit mounting portion, on which an ink-jet head opposing said printing object is mounted, moving means for moving said ink-jet unit mounting portion relative to said printing object mounting portion in an opposing direction, a sensor provided at said ink-jet unit mounting portion for sensing a clearance between said sensor and a side of said printing object mounting portion opposing said sensor, said method comprising the steps of:

feeding said printing object mounted on said printing object mounting portion to a sensing position of said sensor;

moving said ink-jet unit mounting portion in a first moving step with said moving means;

sensing whether or not a clearance between said sensor and said printing object is a predetermined clearance with said sensor;

moving said ink-jet unit mounting portion in a second moving step from a position where said clearance between said sensor and said printing object equals the predetermined clearance by a predetermined moving magnitude with said moving means; and ejecting ink from said ink-jet head and printing on said printing surface of said printing object.

26. An ink-jet printing method as claimed in claim 25, wherein said first moving step moves said ink-jet unit mounting portion in a direction where said ink-jet unit mounting portion is caused to close with said printing object mounting portion, and said sensing step senses a condition that said clearance between said sensor and said printing object becomes less than the predetermined clearance.

27. An ink-jet printing method as claimed in claim 25, further comprising the step of:

before said feeding step, preliminarily moving said ink-jet unit mounting portion with said moving means so that a distance between said ink-jet unit mounting portion and said printing object mounting portion is at least a predetermined distance.

28. An ink-jet printing apparatus comprising:

a printing object mounting portion, on which a printing object is mounted;

an ink-jet unit mounting portion arranged to be shifted relative to said printing object mounting portion, and mounting an ink-jet head for opposing a printing surface of said printing object;

moving means for moving said ink-jet unit mounting portion relative to said printing object mounting portion in an opposing direction;

a sensor provided at said ink-jet unit mounting portion, said sensor sensing a clearance between said sensor and a side of said printing object mounting portion opposing said sensor;

movement control means for controlling movement of said ink-jet unit mounting portion by said moving means in a state that said printing object mounted on said printing object mounting portion is fed to a sensing position of said sensor, said movement of said ink-jet unit mounting portion including a first movement for moving said ink-jet unit mounting portion so that a clearance between said sensor and said printing object equals a predetermined clearance, and a second movement for moving said ink-jet unit mounting portion after said first movement; and printing control means for controlling printing on said printing surface of said printing object by said ink jet head after said second movement is performed by said movement control means.

29. An ink-jet printing apparatus according to claim 28, wherein said movement control means controls said moving means before said printing object is fed to the sensing position of said sensor so that a distance between said ink-jet unit mounting portion and said printing object mounting portion is at least a predetermined distance.

30. An ink-jet printing apparatus as claimed in claim 29, wherein said first movement by said moving means is movement of said ink-jet unit mounting portion in a direction where said ink-jet unit mounting portion is caused to close with said printing object mounting portion.

31. An ink-jet printing apparatus as claimed in claim 29, wherein said ink-jet head generates bubbles utilizing thermal energy and thereby ejects ink.

* * * * *

UNITED STATES PATENT AND TRADEMARK OFFICE

CERTIFICATE OF CORRECTION

PATENT NO. : 5,872,579 Page 1 of 6

DATED : February 16, 1999

INVENTOR(S) : HANDA ET AL.

It is certified that error appears in the above-identified patent and that said Letters Patent is hereby corrected as shown below:

Title page, item

[57] ABSTRACT:

Line 19, "relatively shifting" should be deleted.

COLUMN 1:

Line 13, "droplet is" should read --droplets are--.

Line 26, "of" should read --or--, and "or" should read --of--.

Line 61, "may" should be deleted, and "or" should read --on--.

Line 63, "wedge shaped" should read --wedge-shaped--.

COLUMN 2:

Line 35, "driving" should begin a new paragraph.

COLUMN 4:

Line 22, "this, manner" should read --this manner,--.

Line 42, "titled" should read --tilted--.

UNITED STATES PATENT AND TRADEMARK OFFICE

CERTIFICATE OF CORRECTION

PATENT NO. : 5,872,579 Page 2 of 6

DATED : February 16, 1999

INVENTOR(S) : HANDA ET AL.

It is certified that error appears in the above-indentified patent and that said Letters Patent is hereby corrected as shown below:

COLUMN 5:

Line 3, "both" should read --respective--.

Line 29, "belt against" should read --belt, against--.

Line 45, "tactable" should read --tactable with--.

Line 54, "with" should be deleted.

COLUMN 6:

Line 23, "bubble" should read --bubbles--.

Line 44, "this, manner" should read --this manner,--.

Line 52, "the" (first occurrence) should read --a--, and "object," should read --object--.

Line 55, "shifted" should be deleted, and "to" should read --can shift--.

Line 56, "shift" should read --shifted--.

COLUMN 7:

Line 11, "portion," should read --portion--.

Line 25, "bubble" should read --bubbles--.

Line 29, "information" should read --information,--.

UNITED STATES PATENT AND TRADEMARK OFFICE

CERTIFICATE OF CORRECTION

PATENT NO. : 5,872,579 Page 3 of 6

DATED : February 16, 1999

INVENTOR(S) : HANDA ET AL.

It is certified that error appears in the above-identified patent and that said Letters Patent is hereby corrected as shown below:

COLUMN 8:

Line 4, "tiled" should read --tilted--.

Line 59, "a yet" should read --yet a--.

COLUMN 9:

Line 47, "1150" should read --1150--.

Line 48, "1150" should read --1150--.

COLUMN 10:

Line 1, "1150" should read --1150--.

Line 3, ", thereby" should read --thereby,--.

Line 13, "An" should read --A--.

Line 34, "a" should read --are--.

Line 43, "this, manner" should read --this manner,--.

COLUMN 11:

Line 49, "back-and forth" should read --back-and-forth--.

UNITED STATES PATENT AND TRADEMARK OFFICE

CERTIFICATE OF CORRECTION

PATENT NO. : 5,872,579 Page 4 of 6

DATED : February 16, 1999

INVENTOR(S) : HANDA ET AL.

It is certified that error appears in the above-identified patent and that said Letters Patent is hereby corrected as shown below:

COLUMN 12:

Line 22, "is" should be deleted.

Line 23, "portion , of" should read --portion of--.

Line 24, "or" should read --on--.

COLUMN 13:

Line 41, "S6." should read --S6,--.

COLUMN 15:

Line 1, "discs rotary" should read --rotary discs--.

COLUMN 16:

Line 8, "1290" should read --1290--.

COLUMN 17:

Line 17, "the" should read --that--.

COLUMN 18:

Line 6, "to use" should read --use of--.

Line 17, "1750" should read --1750--.

UNITED STATES PATENT AND TRADEMARK OFFICE

CERTIFICATE OF CORRECTION

DATED : February 16, 1999

INVENTOR(S) : HANDA ET AL.

It is certified that error appears in the above-identified patent and that said Letters Patent is hereby corrected as shown below:

Line 47, "1750," should read --1750,--.

Line 57, "this, manner" should read --this manner,--.

COLUMN 19:

Line 28, after "each" --of-- should be inserted.

Line 38, "this, manner" should read --this manner,--.

COLUMN 24:

Line 9, "bar guide" should read --guide bar--.

COLUMN 25:

Line 4, "not" should read --not be--.

COLUMN 27:

Line 7, "system," should read --system--.

Line 10, "system," should read --system--.

Line 44, "printing--surface" should read --printing surface--.

Line 52, "magnitudes" should read --magnitude--.

Line 57, "ink-let" should read --ink-jet--.

UNITED STATES PATENT AND TRADEMARK OFFICE

CERTIFICATE OF CORRECTION

PATENT NO. : 5,872,579 Page 6 of 6

DATED : February 16, 1999

INVENTOR(S) : HANDA ET AL.

It is certified that error appears in the above-identified patent and that said Letters Patent is hereby corrected as shown below:

COLUMN 28:

Line 28, "tioning" should read --tion in--.

Line 52, "ink-let" should read --ink-jet--.

Signed and Sealed this

Sixteenth Day of November, 1999

*Attest:*

Q. TODD DICKINSON

*Attesting Officer*

*Acting Commissioner of Patents and Trademarks*